US006760556B2

(12) United States Patent
De Kesel et al.

(10) Patent No.: US 6,760,556 B2
(45) Date of Patent: Jul. 6, 2004

(54) SEALING MEMBER AND TONER CONTAINER PROVIDED WITH SUCH A SEALING MEMBER

(75) Inventors: Jan De Kesel, Drongen (BE); Gino Sirejacob, Evergem (BE); Alexander Van Betsbrugge, Deinze (BE)

(73) Assignee: CF Technologies, Deinze (BE)

( * ) Notice: Subject to any disclaimer, the term of this patent is extended or adjusted under 35 U.S.C. 154(b) by 0 days.

(21) Appl. No.: 10/197,240

(22) Filed: Jul. 16, 2002

(65) Prior Publication Data

US 2004/0013444 A1 Jan. 22, 2004

(51) Int. Cl.[7] ..... G03G 15/08
(52) U.S. Cl. ..... 399/106; 399/99
(58) Field of Search ..... 399/106, 102, 399/103, 105, 98, 262, 99; 222/DIG. 1; 141/363, 364, 368

(56) References Cited

U.S. PATENT DOCUMENTS

| | | | | | |
|---|---|---|---|---|---|
| 4,062,385 | A | * | 12/1977 | Katusha et al. | 141/364 X |
| 5,110,646 | A | | 5/1992 | Prestel et al. | |
| 5,177,540 | A | * | 1/1993 | Honda et al. | 399/106 |
| 5,671,461 | A | * | 9/1997 | Ishii | 399/106 X |
| 5,778,282 | A | * | 7/1998 | Nagashima | 399/106 |
| 5,930,559 | A | | 7/1999 | De Kesel | 399/106 |
| RE36,920 | E | | 10/2000 | De Kesel | 399/106 |
| 6,587,657 | B2 | * | 7/2003 | Sirejacob | 399/106 |
| 2001/0033909 | A1 | | 10/2001 | Cornelius et al. | 428/114 |

FOREIGN PATENT DOCUMENTS

| | | | | |
|---|---|---|---|---|
| EP | 01161274 | A1 | 6/1989 | |
| EP | 01310372 | | 12/1989 | |
| EP | 02028673 | | 1/1990 | |
| EP | 04006046 | | 1/1992 | |
| EP | 0 788 033 | A1 | 8/1997 | |
| GB | 2286062 | A | 8/1995 | G06G/15/08 |
| GB | 2289238 | A | 11/1995 | G03G/15/08 |
| JP | 05-265323 | * | 10/1993 | |
| JP | 06-242675 | * | 9/1994 | |
| JP | 2002-040780 | A | 2/2002 | |

* cited by examiner

*Primary Examiner*—Sophia S. Chen
(74) *Attorney, Agent, or Firm*—Darby & Darby

(57) ABSTRACT

Sealing member for toner container having a tearable central strip and being associated with connecting elements ensuring the pressing of the lateral portions of a compressible cleaning element, with respect to the portion of the cleaning element intended for cleaning the torn central strip.

125 Claims, 17 Drawing Sheets

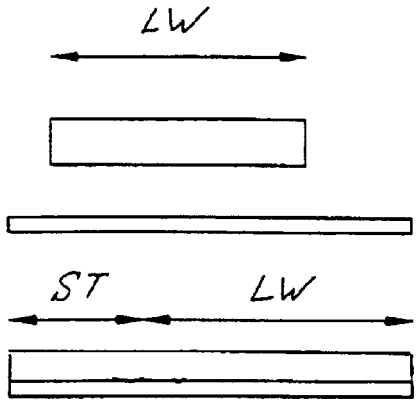
Fig.9
Fig.10
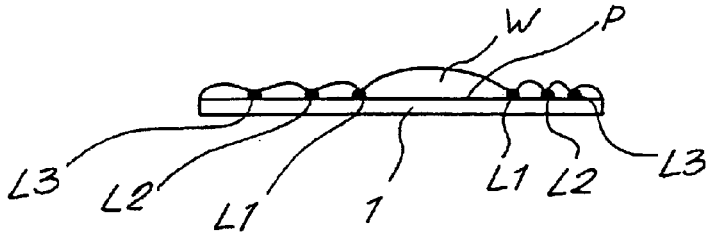
Fig.11
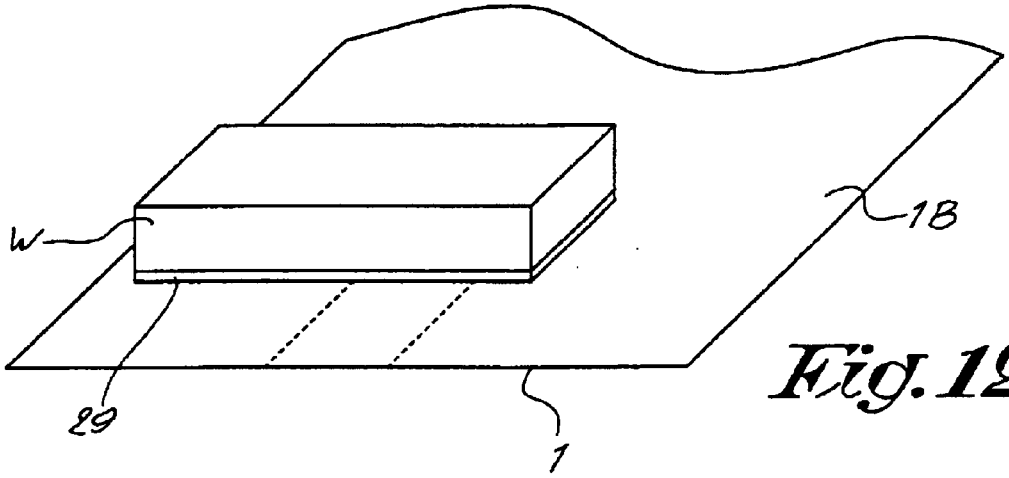
Fig.12
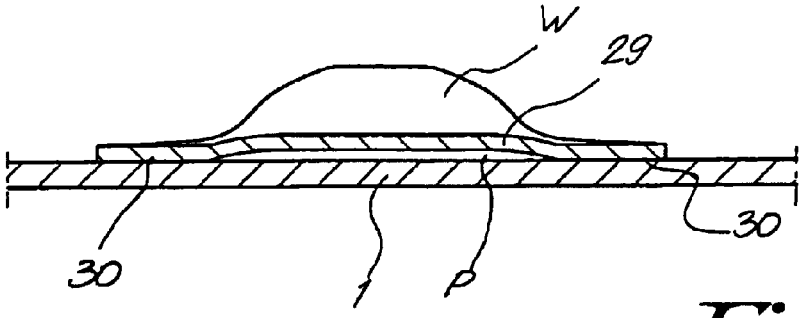
Fig.13

Fig. 16
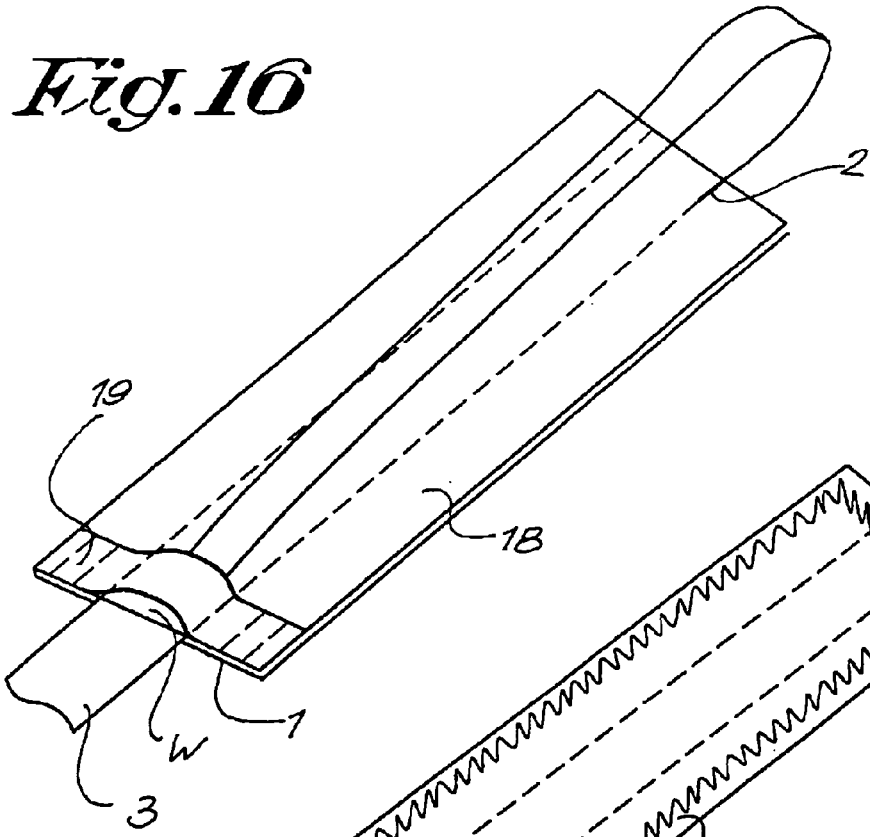
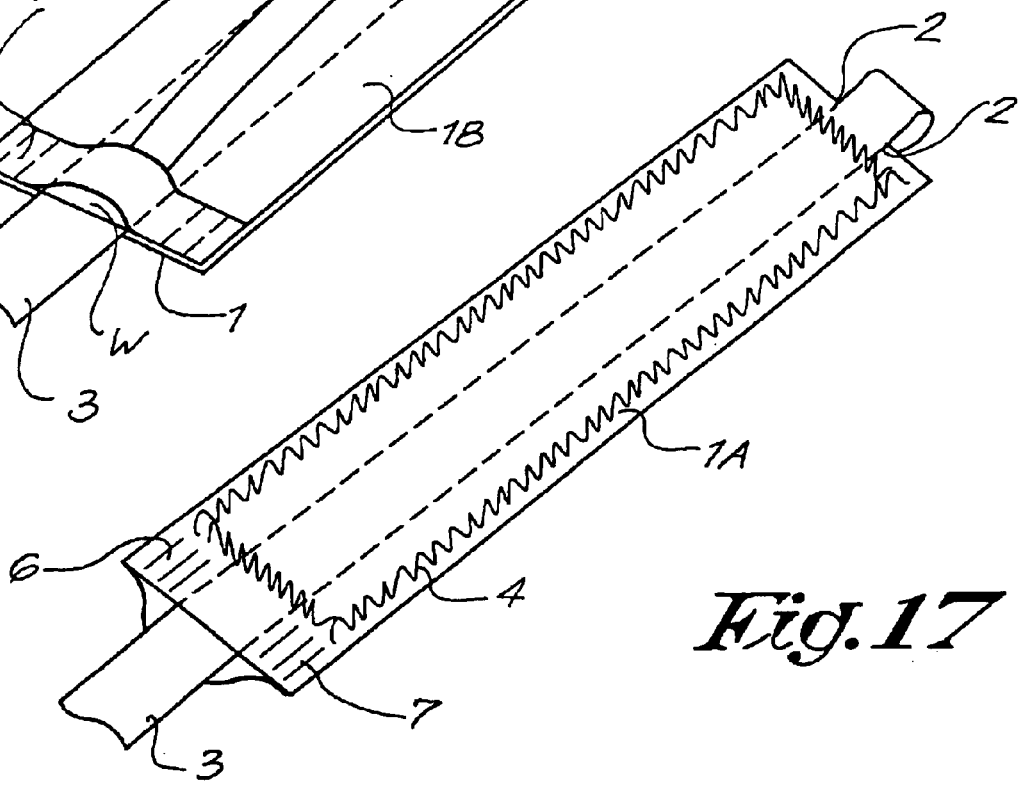
Fig. 17
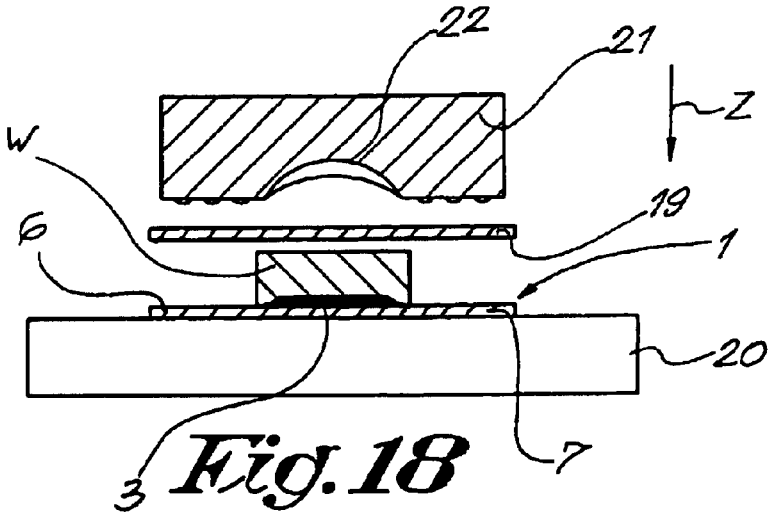
Fig. 18

SEALING MEMBER AND TONER CONTAINER PROVIDED WITH SUCH A SEALING MEMBER

FIELD OF THE INVENTION

The invention relates to a sealing member of a toner container, said sealing member having a film with a central strip to be torn off. The sealing member is associated with a wiping element so as to clean the torn central strip.

THE PRIOR ART

Sealing member for toner container, such as toner container of toner cartridges of copier, laser printer, printer, etc. comprising a sealing film with a central strip intended to be torn off. When the sealing film closes an opening of a toner container, the face of the central strip directed towards the inner side of the container is provided with toner particles. When tearing said strip, particles present on the strip can be liberated in the atmosphere, whereby causing a risk of soiling the hands or clothing of the operator.

For solving this problem, it has already been proposed to provide on the toner container a wiping element intended to be in contact with the torn strip during its removal from the sealing film. (see UK 2 286 062). However this solution has the drawback that two distinct operations are required when recycling a toner container, as the sealing member and the wiping element have to be replaced. It means also that the risk exist that the wiping element is not correctly placed, although the sealing member is correctly placed, and inversely. Furthermore, as the wiping element is distant from the sealing film, the wiping element does not form an appropriate guiding means for the pulling means and for the torn strip.

Sealing films have already been provided with foam layers, such as a foam layer with a central slot.

For example U.S. Pat. No. 5,930,559 and UK 2 289 238 (DE KESEL) disclose a sealing film provided with a foam layer, whereby when tearing the central strip, the pulling means and thereafter the central strip contact a part of the foam. According to said US patent, said part of the foam contacting the torn central strip is advantageously provided with a layer with a low friction coefficient. As the foam layer is pressed between a surface of the container and a surface of an element supporting a roller, a wiping or cleaning of the central strip is obtained. Said wiping or cleaning is not optimum for example along the edges of the torn central strip.

A similar foam element for wiping the central strip is also taught in U.S. patent application Ser. No. 2001/0033909.

The invention relates to sealing members ensuring an excellent cleaning or wiping of the torn strip, even along its longitudinal edges, so as to prevent substantially any soils risks.

BRIEF DESCRIPTION OF THE INVENTION

The invention relates to a sealing member for sealing an opening of a surface of a toner container for laser printers, copy machines and fax machines, said sealing member comprising:

a sealing film comprising a first portion with a first face directed towards the surface for sealing the opening of the toner container and a second face opposite to said first face, said first portion comprising a longitudinal central strip intended to be torn off, said central strip extending from a first end up to a second end and having a substantially predetermined width, a wiping element for wiping the portion of the first face of the sealing film corresponding to the central strip when contacting the torn central strip with the wiping element, a pulling member bound to the first end of the central strip, said pulling member being intended to extend before the tearing off of the central strip at least partly above the second face of the sealing film, in which the wiping element is attached a component selected from the group consisting of the sealing film, a foam layer attached to the sealing film, a non foam support attached to the sealing film, and combinations thereof, by at least a connecting means selected from the group consisting of:

combinations of at least a first welding and a second welding;

one connecting element attached to the component by a first welding and a second welding, two distinct connecting elements, a first of which is attached to the component by a first welding, while the second is attached to the component by a second welding, two distinct connecting elements, a first of which is attached to a first component by a first welding, while the second is attached to another component by a second welding, and combinations thereof, whereby the first welding and the second welding are distant from each other so as to define there between a passage for the torn central strip.

By using weldings, such as welding lines, it is possible to define very precisely the edges of the passage and to ensure an excellent bond between the wiping element and the sealing film, a foam layer glued on the sealing film, a substantially rigid support attached to the sealing film, etc., whereby preventing the accidental tearing of the wiping element during the tearing of the central strip.

Welding lines or points are also very appropriate for so as to ensure a higher compression of the wiping element along its portions having to contact the longitudinal edges of the torn central strip and/or for ensuring a transversal stretching of the wiping element with respect to the sealing film.

The invention relates also to a toner container, the opening of which is sealed with a film of the invention, as well as to a toner cartridge provided with such a toner container.

The invention relates also to a sealing member for sealing an opening of a surface of a toner container for laser printers, copy machines and fax machines, said sealing member comprising:

a sealing film with a first face intended to be directed towards the surface for sealing the opening of the toner container and a second face opposite to said first face, said film comprising a longitudinal central strip intended to be torn off, said central strip extending from a first end up to a second end and having a substantially predetermined width, a wiping element for wiping the portion of the first face of the sealing film corresponding to the central strip when contacting the torn central strip with the wiping element, the wiping element having two lateral side portions and a central portion extending between said lateral portions, a pulling member bound to the first end of the central strip, said pulling member being intended to extend before the tearing off of the central strip at least partly above the second face of the sealing film, in which the wiping element is attached to a component selected from the group consisting of the sealing film, a foam layer attached to the sealing film, a non foam support attached to the sealing film, and combinations thereof, by at least one connecting means ensuring or adapted for ensuring when the sealing film seals the opening of the surface of the container, a pressure between the lateral portions of the wiping element and the surface with the sealed opening, while defining a passage between said lateral portions of the wiping element, and between the central portion of the wiping element and the component.

The invention further relates to a toner container provided with such a sealing member or provided with a connecting means ensuring a pressure between the lateral portions of the wiping element and the surface with the sealed opening.

GENERAL DESCRIPTION OF EMBODIMENTS OF THE INVENTION

In the present specification, wiping and cleaning are used for designating the removal of toner particles present on the central strip, when the central strip is torn out of the sealing film.

The invention relates to a sealing member for sealing an opening of a surface of a toner container for laser printers, copy machines and fax machines, said sealing member comprising:

a sealing film comprising a first portion with a first face directed towards the surface for sealing the opening of the toner container and a second face opposite to said first face, said scaling film comprising a longitudinal central strip intended to be torn off, said central strip extending from a first end up to a second end and having a substantially predetermined width, a wiping element for wiping the portion of the first face of the sealing film corresponding to the central strip when contacting the torn central strip with the wiping element, a pulling member bound to the first end of the central strip, said pulling member being intended to extend before the tearing off of the central strip at least partly above the second face of the sealing film.

According to a first general embodiment of the invention, the wiping element is attached to a component selected from the group consisting of the sealing film, a foam layer attached to the sealing film, a non foam support attached to the sealing film, and combinations thereof, by at least a connecting means selected from the group consisting of one connecting element attached to the component by a first welding and a second welding, two distinct connecting elements, a first of which is attached to the component by a first welding, while the second is attached to the component by a second welding, and two distinct connecting elements, a first of which is attached to a first component by a first welding, while the second is attached to another component by a second welding, whereby the first welding and the second welding are distant from each other so as to define there between a passage for the torn central strip.

Although the welding can be made by using an intermediate material, the wiping element has advantageously a first portion and a second portion which are welded to the sealing film so as to define between said portion a passage with a width at least substantially equal to the width of the central strip.

Preferably, the sealing member is arranged for or is provided with a means adapted for creating at least a relative transverse tension (i.e. a tension perpendicular to the longitudinal direction of the central strip) between the component, preferably the sealing film, and the wiping element when the sealing film seals the opening of the toner container.

According to an advantageous detail of an embodiment, the wiping element is attached to the component, preferably the sealing film, at least by means of two welding lines, said welding lines forming guiding means for the torn central strip during its tearing. Said welding lines are straight welding lines or welding lines with curved or inclined portions. Such welding lines ensures a good cleaning of the longitudinal edges of the torn central strip.

The first and second weldings are selected from the group consisting of hot welding (preferably under pressure, for example for the welding of a layer of the wiping element with a layer of the sealing film, the temperature of the welding is preferably higher than the softening point of a layer of the wiping element and of a layer of the sealing film, preferably higher than the melting point of said layers), cold welding (welding made with no or low heating), wave welding such as ultra sound welding, reactive welding (for example the sealing film and the wiping element have surfaces in contact which can react together so as to make chemical bond, such as silicon bond, so as to cross link said two surfaces (possibly, if necessary an intermediate element or composition can be placed between the surfaces to be welded together, so as to add some reactants or catalysts for the reaction), solvent welding (for example by placing a solvent or a solvent mixture suitable for dissolving at least partly one or more components or polymers of the sealing film and of the wiping element (the polymers of the wiping element and of the sealing film can then mix together), combinations of these welding techniques. Pressure is preferably exerted on the surface to be welded together during the welding operation. In order to increase the welding of the surface together, it is possible to submit the surfaces to be welded to one or more pretreatments, such as cleaning or washing steps (for removing possible dust, oils, etc.), brushing steps, etc.

For example, the wiping element is made at least partly of a material selected from the group consisting of weldable materials, materials provided with at least one weldable layer, solvent soluble materials, materials provided with solvent soluble layer, reacting materials and materials provided with a reactive layer, while the sealing film is at least partly made of weldable materials, materials provided with at least one weldable layer, solvent soluble materials, materials provided with solvent soluble layer, reacting materials and materials provided with a reactive layer. When the wiping element and the sealing film are welded together, the wiping element and the sealing film comprises at least portions or layers which are compatible to each other.

According to an embodiment, the wiping element is made of a compressible material, said wiping element having a first wiping portion adjacent to the first welding and a second wiping portion adjacent to the second welding, whereby said first and second wiping portions are compressed. Preferably, the wiping element comprises a third wiping portion located between the first and second wiping portions, said third wiping portion being less compressed with respect to the first and second wiping portions. For example, the wiping element comprises a compressible foam layer, said foam layer having a first portion and a second portion welded to the sealing film in a compressed state.

According to a specific embodiment, the sealing film and the wiping element are made of compatible thermoplastic materials, such as polyethylene (low density, medium density, high density, combination thereof), polypropylene, polyurethane, etc. The sealing film and the wiping element are then advantageously welded together.

According to a characteristic of an embodiment, the first face of the sealing film is provided with an adhesive layer for attaching the sealing film on the surface of the container to be sealed, whereby at least the first face of the portions of the film attached by the first welding and the second welding to the wiping element are provided adhesive for attaching said portion on the surface of the container to be sealed. This ensures that when the sealing film seal the opening of the toner container, no lateral or transversal movement of the weldings will occur with respect to the container.

Possible wiping element are foam element, wiper, felt, antistatic layer, friction reducing layer, material releasing friction reduction agent, material releasing antistatic agent, releasing layer, magnetic material and combinations thereof. The layer can be applied on a support, such as a film, a blade, a foam, etc. The support is for example not provided with the appropriate layer at the place where the support is welded to the film.

Advantageously, the sealing film is provided with gluing means for attaching the sealing film on the surface of the container with the opening to be sealed.

According to a possible embodiment, the sealing film is provided with at least one foam element, such as a slotted foam element, said foam element can possibly be a support for the wiping layer. In the latter case, the support is welded to the film at least near the wiping layer.

According to another possible embodiment, the sealing film is provided with at least one foam element, said foam element being provided with gluing means for attaching the sealing member to the surface of the container with the opening to be sealed.

According to a specific embodiment, in which the torn central strip has two substantially parallel longitudinal edges defining there between a width, the first welding and second welding are distant from each other from a distance corresponding to less than 120% of the width of the central strip, preferably to less than about 110% of the width the central strip.

Most preferably, the first welding and second welding are substantially parallel welding lines. Possibly said lines can be inclined with respect to the longitudinal direction of the strip, so that the width of the passage is increased in the pulling direction.

The sealing member can be associated to a means for ensuring at least a transversal stretching of the wiping element, when the sealing film seals the opening of the toner container. For example the wiping element is at least partly elastic and the wiping element is stretched before being welded to the sealing film. Such a stretching is advantageous for ensuring a good wiping of the element on the strip to be torn.

According to a possible embodiment, the first and second weldings are weldings between the sealing film and intermediate elements bound to the wiping elements.

According a second general embodiment of sealing members of the invention, the sealing member comprises:

a sealing film with a first face intended to be directed towards the surface for sealing the opening of the toner container and a second face opposite to said first face, said film comprising a longitudinal central strip intended to be torn off, said central strip extending from a first end up to a second end and having a substantially predetermined width, a wiping element for wiping the portion of the first face of the sealing film corresponding to the central strip when contacting the torn central strip with the wiping element, the wiping element having two lateral side portions and a central portion extending between said lateral portions, a pulling member bound to the first end of the central strip, said pulling member being intended to extend before the tearing off of the central strip at least partly above the second face of the sealing film, in which the wiping element is attached to a component selected from the group consisting of the sealing film, a foam layer attached to the sealing film, a non foam support attached to the sealing film, and combinations thereof, by at least one connecting means for ensuring or adapted for ensuring a pressure between the lateral portions of the wiping element and the component, whereby a passage is defined between said lateral portions of the wiping element, and between the central portion of the wiping element and the component.

Advantageously, the connecting means exerts or is adapted for exerting a pressure between the lateral portions of the wiping element and the component sufficient for forming guiding means for torn central strip during its tearing.

Preferably, the connecting means exerts or is adapted for exerting a pressure between the lateral portions and the component which is greater than the pressure of the central portion of the wiping element and the component.

According to a detail, the connecting means is adapted for preventing the tearing off of the wiping element during the tearing of the central strip.

According to a specific detail of an embodiment, the connecting means is a mechanical means acting at least between the lateral portions of the wiping element and the component.

Advantageously, the sealing member is further provided with at least one support means for facilitating the placement of the sealing member. For example, the sealing member is further provided with at least one cardboard support for facilitating the placement of the sealing member, said cardboard support being attached to the second face of the sealing film.

Advantageously, the wiping or cleaning element is selected from the group consisting of foam element, wiper, felt, antistatic layer, friction reducing layer, material releasing friction reduction agent, material releasing the antistatic agent, releasing layer, magnetic material, fibrous material and combinations thereof. The wiper, foam, etc. can possibly be made of a material of similar nature than the sealing film. The wiper can possibly be a simple film or blade. As wiping or cleaning means, it is advantageous to use material suitable for adsorbing or absorbing toner particles or a material having a higher affinity for the toner particles.

Examples of wiping means or cleaning means (which can have various forms, such as cylinders, rectangular bloc, layer, etc.) are fibrous containing material, cellulosic containing material, wool, glass fibre mat, foam material with open cells, foam material with open cells and outer skin layer, felt, foam material with closed cells, paper layer, paper napkin, foam layer made from polymeric, copolymer material, polyesters, polyurethane, polypropylene, fluoro polymer, polystyrene, etc. and mixtures thereof, elements made from cork, etc, this materials or elements being advantageously filled or charged with one or more additives, such as additives for reducing the friction (such as oils, silicone oils, silicon polymer, Teflon, Teflon powder, fluoropolymers, fluoro containing powder, clay powder, bentonite powder, china clay, mica, graphite, carbon particles, toner particles, fluorine coating or treatment, etc., and mixtures thereof), antistatic additives (such as aminosilane, aluminium oxide, quaternary ammonium compound, quaternary ammonium salts, polyamine, ethoxylated sorbitan ester, glycerol monostearate, quaternized hydrocarbon, stearamidopropyl dimethyl-beta-hydroxyethylammonium nitrate, fatty imidazoline, polyethylene glycol, alkyl sulphonate, alkylamine derivatives, fatty amine derivative, organic phosphate esters, polypropoxy quaternary ammonium chloride, polypropoxy quaternary ammonium acetate, phosphated aliphatic alcohol, laurate ester, surfactants, cationic surfactants, zwitteronic surfactants, carbon black, polyoxyethylene laurate, potassium cocoyl hydrolyzed collagen, polyoxyethylene coco amine, modified amine, monocarboxylic stearic derivative, polyquaternary ammonium salt, complex phosphate ester, phosphoniums, cationic compound, fluorocarbon protectant, organic phosphate esters, PEG-15 tallow polyamine, sorbitan monolaurate, ethoxylatedtetramethyl decynediol, cocodimonium hydrolyzed soy protein, polyacrylic and/or polymethacrylic acid and their derivatives, alcohol phosphate, sulfonated polystyrene, etc., and their mixtures), releasing agents (such as ethylene bis(stearamide), sulfated oil, dioctyl ester of sodium sulfosuccinic acid, microcrystalline waxes, oxidized microcrystalline waxes, ammonium stearate dispersion, ethylcellulose, monoalkyl primary amine, erucamide, hydrogenated tallow amide, oleamide, stearamide, straight aliphatic chain, polymeric ester, high molecular weight polymeric ester, rapeseed oil, non ionic fatty esters, polyethylene glycols, hydrogenated castor oils, paraffinic microcrystalline wax, petroleum wax, emulsifiers, polyethylene, fatty acid esters, stearate, monoacid triglyceride powder, trimyristin, silicone oil, dimethylsiloxane, phosphated mono- and diglycerides, erucamide, glycerol monostearate, dimethyl ammonium ethosulfate, alkyl dimethylethylammoniumetosulfate, stearyldimethylethyl ammonium ethosulfate, hydantoin, polypropylene glycols, silicone emulsion, polyethylene and polyester derivatives, amide waxes, iso-eicosyl alcohol, stearate, silica, ethylene/propylene compounds, polyethylene, crystalline polyethylene, glycerol monostearate, soap, lactic acid salts, vegetable oil, ethoxylated alcohol, phosphate ester, hydrogenated vegetable oil, alcohol phosphate, etc., and their mixtures), magnetic powders, polyvinyl pyrrolidone, polyvinyl alcohol, etc.

One or more additives can be added to the wiping material or layer, by preparing a solution or suspension containing said additives, by applying said solution or suspension on the wiping element, and by removing the excess of liquid or solvent of the solution or suspension. The application of the suspension or solution can be made by dipping, brushing, painting, rubbing, dabbing, pushing, sucking, vaporising, etc. When using solid particles, the solid particles additives can be added to the wiping material by blowing the particles on the wiping element.

Other techniques can also be used for providing a low friction and/or antistatic and/or anti adherent properties to the wiping elements, Such other techniques are for example gas (fluorine/chlorine/etc.) treatments, vapour deposition, etc.

The sealing film can be made in various material, such as mono layered material, bi layered material, multilayered material, etc. For example the sealing film is a polyethylene film, a polypropylene film, a film comprising a thin foamed layer, the combination of a foam layer with a polypropylene film layer, a combination of one or more polymeric layers with one metal (aluminium) layer. The sealing film has preferably a preferential tearing direction or is provided with means for ensuring a preferential tearing of the central strip. The sealing film has a thickness for example comprised between 25 $\mu$m and 500 $\mu$m, such as 50 $\mu$m, 100 $\mu$m, 150 $\mu$m, etc. The sealing film can be provided possibly with a coating or a further layer on at least a part of the central strip to be torn off.

The sealing film is advantageously provided with gluing means for attaching the sealing film on the surface of the container with the opening to be sealed. A removable protection sheet could be used for protecting the gluing means or adhesion means before its gluing on the surface. Such a removable protection sheet, such as a siliconized paper, is removed just before the placement of the sealing film.

According to a possible characteristic of the first embodiments, the sealing film is provided with at least one foam element, such as a foam layer with a central slot, longitudinal foam elements such as disclosed in U.S. Pat. No. 5,930,559 (the content of which is incorporated to the present specification by reference), transversal foam elements, or a combination thereof.

As disclosed in U.S. Pat. No. 5,930,559, the sealing film can be provided with at least one foam element, said foam element being provided with gluing means for attaching the sealing member to the surface of the container with the opening to be sealed. For example, the foam element has a width greater than the width of the sealing film, so that when gluing the foam element on the surface of the toner container, the sealing of the opening is made by the sealing film, even if said sealing film is not glued on the toner container.

Such foam element present on the first portion of sealing film acts as a wiping element or cleaning element or element for decreasing the adhesion of toner particles. According to a possible characteristic of the first embodiment, the first portion of the film is provided with a wiping element, whereby when the central strip has been torn off, said central strip has been wiped first by the wiping element of the first portion and then with the wiping element of the second portion of the sealing film.

Advantageously, especially in case the sealing film is not provided with a foam element or a foam layer, the sealing member is further provided with at least one support means for facilitating the placement of the sealing member.

The sealing film is advantageously provided with means for lowering the initial tearing force of the central strip. Such a means is for example disclosed in Re 36920, the content of which is incorporated to the present specification by reference.

According to a possible embodiment, the wiping element extends at least partly outside the sealing film. This is advantageous for not having to modify the quality and structure of existing sealing films.

According to a detail of a specific embodiment, the wiping element is covered at least partly by a connecting element attached to the sealing film by a first welding and by a second welding distant from each other so as to define there between a passage for the torn central strip. Preferably, the connecting element is selected from the group consisting of films weldable to the sealing film, and layers bound to the wiping element and which are weldable to the sealing film.

According to another detail of an embodiment, the wiping element is covered at least partly by a weldable film, said film having a first portion and a second portion which are welded to the sealing film so as to define between said portion a passage with a width at least substantially equal to the predetermined width of the central strip.

The wiping element can be attached to the connecting means by at least one bond selected from the group consisting of welding points, welding lines, welding zones, adhesives, seams, mechanical fixing elements, and combinations thereof.

According to a specific embodiment, the wiping element is covered by a film having two distant portions contacting the sealing film and welded to the sealing film, whereby the sealing film is made of weldable materials, materials provided with at least one weldable layer, solvent soluble materials, materials provided with solvent soluble layer, reacting materials and materials provided with a reactive layer.

The invention relates also to toner containers provided with a sealing member of the invention for sealing the opening for the passage of toner towards the image bearing element, possibly via a magnetic roller or another roller.

According to a specific embodiment of a toner container of the invention, the toner container is provided with a sealing member for sealing the opening, whereby the sealing member comprises:

- a sealing film with a first face intended to be directed towards the surface for sealing the opening of the toner container and a second face opposite to said first face, said film comprising a longitudinal central strip intended to be torn off, said central strip extending from a first end up to a second end and having a substantially predetermined width,
- a wiping element for wiping the portion of the first face of the sealing film corresponding to the central strip when contacting the torn central strip with the wiping element, the wiping element having two lateral side portions and a central portion extending between said lateral portions,
- a pulling member bound to the first end of the central strip, said pulling member being intended to extend before the tearing off of the central strip at least partly above the second face of the sealing film,
- in which the wiping element is attached to a component selected from the group consisting of the sealing film, a foam layer attached to the sealing film, a non foam support attached to the sealing film, and combinations thereof, and in which at least one connecting means ensure a pressure between the lateral portions of the wiping element and the component, whereby a passage is defined between said lateral portions of the wiping element, and between the central portion of the wiping element and the component.

The connecting means advantageously exert a pressure between the lateral portions of the wiping element and the component sufficient for forming guiding means for torn central strip during its tearing. Preferably, the connecting means exert a pressure between the lateral portions and the component which is greater than the pressure of the central portion of the wiping element and the component.

The connecting means is for example adapted for preventing the tearing off of the wiping element during the tearing of the central strip.

For example, the connecting means is a mechanical means acting at least on the lateral portions of the wiping element.

The toner container can be associated with a support bearing at least one roller, whereby the sealing member is located between the surface with the opening of the container and the support and whereby the support is provided with a surface adapted with respect to the surface with the opening, so as to ensure a pressure between the lateral portions of the wiping element and the component.

In this specific embodiment of toner container, the connecting means can be an element attached to the container and/or to the support.

Characteristics and details of preferred embodiments will appear from the following description, in which reference is made to the attached drawings.

BRIEF DESCRIPTION OF THE DRAWINGS

FIG. 7 is a schematic view in perspective of another embodiment, while

FIGS. 9 to 11 show the manufacture of a specific embodiment of a sealing member of the invention;

FIGS. 12 and 13 show the manufacture of another specific embodiment of a sealing member of the invention;

FIG. 16 is a perspective view of a further embodiment of a sealing member of the invention;

FIG. 17 is back view of the embodiment of FIG. 16;

FIG. 18 shows schematically a step for the preparation of the embodiment of FIG. 16;

DESCRIPTION OF PREFERRED EMBODIMENTS

The description of preferred embodiments given hereafter is given as examples only and is not restricting the scope of the invention. This description refers to drawings, in which the same numerals are used for indicating similar elements or elements having similar function.

The sealing member is intended for sealing an opening O of a surface S of a toner container TC (see FIG. 4) for laser printers, copy machines and fax machines, for example of a toner cartridge comprising a support for a magnetic roller or drum. The sealing member of FIG. 1 comprises:

a sealing film 1 with a first face 1A intended to be directed towards the surface S for sealing the opening O of the toner container TC and a second face 1B opposite to said first face 1A, said film 1 comprising a central strip CS intended to be torn off, said central strip CS extending from a first end CS1 provided with cuts 2 for reducing the initial tearing force up to a second end CS2, a wiping or cleaning element W for wiping the portion of the first face 1A of the sealing film corresponding to the central strip CS when contacting the torn central strip CS with the wiping element W during a tearing operation, a pulling member 3 bound to the first end CS1 of the central strip CS, said pulling member 3 being intended to extend before the tearing off of the central strip CS at least partly above the second face 1B of the sealing film, as well partly between the wiping element W and the film 1.

The wiping element W is for example made of a compressible, the wiping element comprising a first lateral portion W1 in compressed state and which is welded (heat, ultrasound, etc.) to the film 1, a second lateral portion W2 in compressed state and which is welded (heat, ultrasound, etc.) to the film 1, and a third portion W3 located between the first and second portions W1,W2. The first and second portions W1,W2 are welded to the film by means of three substantially parallel welding lines L1,L2,L3. The welding lines L1 are substantially parallel to the longitudinal direction LD of the central strip CS, which corresponds also to the pulling direction of the pulling means 3. Between the welding lines L1, a passage P is defined for the pulling means 3 and for the central strip CS after its tearing off. Said passage P has a width X greater than the width Y of the pulling means 3 and of the central strip CS, but lower than 1.2 times said width Y. The width Y of the central strip is defined between the two substantially parallel tearing lines CS3,CS4, which can be defined by weakening zones or grooves.

It is obvious that instead of three welding lines, it would be possible to use welding zones, welding points, a greater number of welding lines (for example 4,5,6 or more parallel welding lines), crossing welding lines, welding lines with different widths, etc.

Figure 1:
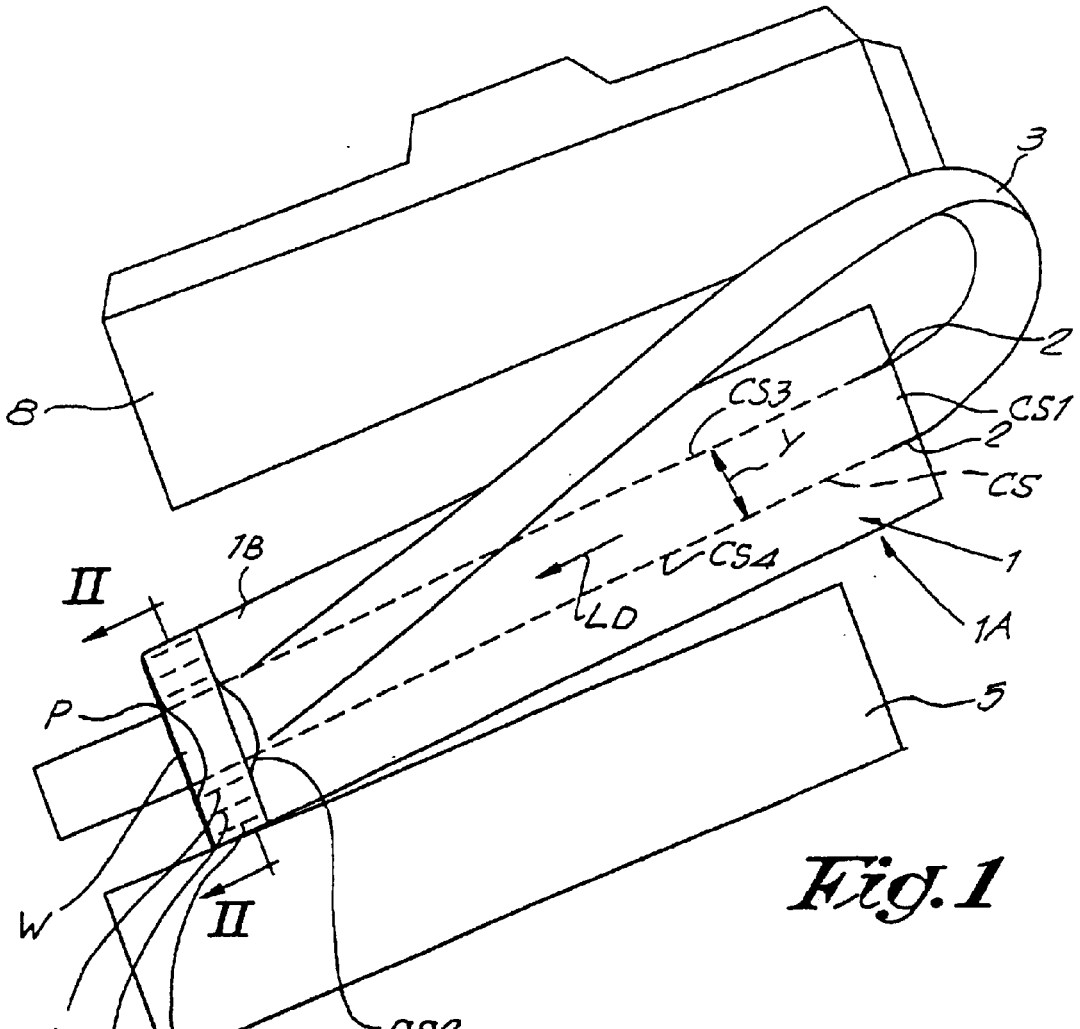
FIG. 1 is an exploded perspective view of a first sealing member of the invention.
Figure 2:
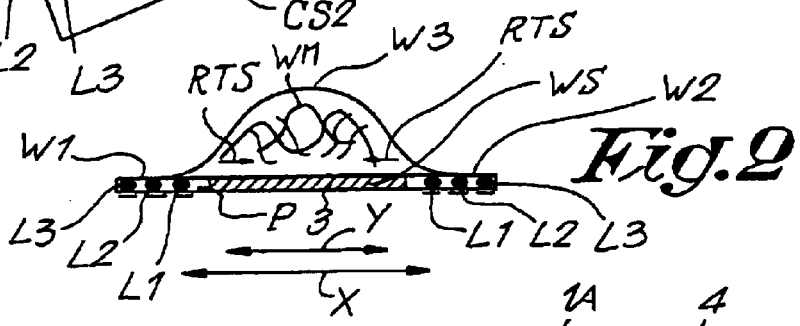
FIG. 2 is a cross section view along the lines II—II of the sealing member of FIG. 1.
Figure 3:
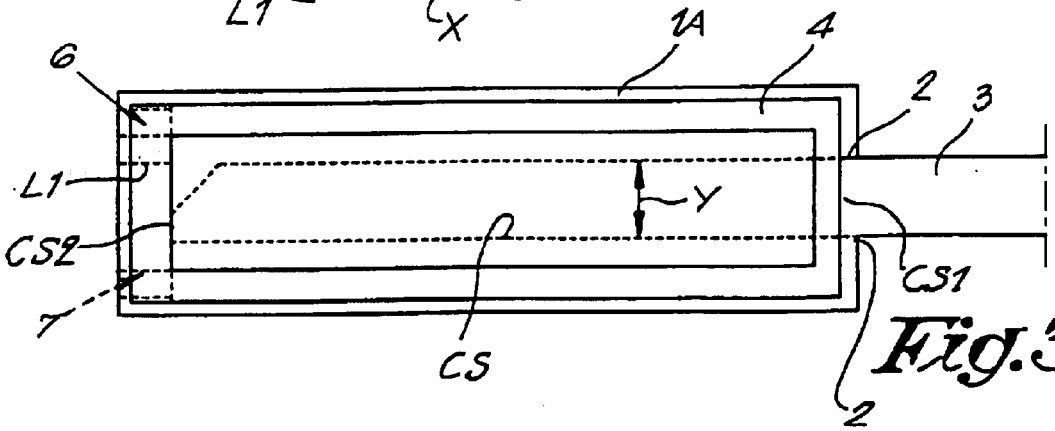
FIG. 3 is a view of the first face of the sealing film of FIG. 1.

The third portion W3 of the wiping element W has a face WS intended to contact the face 1A of the torn central strip CS during its tearing (face in contact with toner particles). The third portion W3 is less compressed in the middle WM than in the portion adjacent to the welding L1. For example, at the welding L1, the thickness is at least 20% lower than thickness of the middle portion of the wiping element W. In a specific embodiment, the thickness of the middle portion of the wiping element W is at least 0.5 mm, advantageously at least 1 mm, for example 1 to 3 mm thicker than the welded portion. In the embodiment of FIG. 1, the thickness of the wiping element at the welding L1 is less than 0.5 mm, such as comprised between 0.1 and 0.4 mm, while the thickness of the middle portion is greater than 1 mm (for example comprised between 1.5 and 3 mm). A variation of compression state of the portion W3 is created between the welding lines L1, whereby relative transverse strength RTS are created between the film and the wiping portion W3. This relative transverse strength RTS is appropriate for exerting some force tending to move or apply the middle portion of the wiping portion W3 towards the film 1, when the film is sealing the opening of the surface of the toner container. The welding lines L1 forms guiding means for the pulling means 3 and for the torn central strip CS. The guiding effect is even further improved due to the higher compression at the portions of the wiping element W adjacent to the welding lines L1, whereby ensuring a higher wearing of the longitudinal edges of the pulling means 3 and of the torn central strip and whereby ensuring a better cleaning of the edge portion of the torn central strip CS, which are often the most difficult to be cleaned correctly.

Furthermore, the higher compression state of the wiping element adjacent to the welding lines L1 can also act as means for regulating or controlling the speed of the tearing operation, so as to ensure a sufficient contact between the wiping or cleaning element 3 and the face 1A of the central strip.

Finally, another advantages of the transverse strength or tension is that after the full tearing of the central strip CS from the film 1, a force is tending to apply the face WS towards the film 1 and/or towards the surface of the container, in case the central strip has a portion extending under the wiping element. Such a force is advantageous so as to avoid that possible trapped toner particles could be released after the tearing of the central strip. Such a risk can also be prevented or avoided by using wiping element having absorbing properties or properties for attracting or attaching particles on or in the wiping element.

When using other materials for the wiping or cleaning element, such as fibrous material, microfibrous material, etc., the thickness of the wiping element can even be lower than 500 $\mu$m, such as lower than 300 $\mu$m, for example lower than 200 $\mu$m, while the degree of compression can be different as those specified. Possibly the wiping element can be the combination of a compressible material with a substantially non compressible material or layer, the latter being intended to contact the central strip to be cleaned.

The sealing film 1 is provided on its face 1A with an adhesive layer 4 following substantially the edge of the film. Said adhesive layer 4 is before application of the sealing film on the surface to be sealed, provided with a removable siliconized paper 5, which is removed before gluing the film 1 on the surface to be sealed.

The adhesive layer 4 is adapted for ensuring that at least the film portions 6,7 to which the cleaning element W is welded by the welding lines L1, preferably by the welding lines L1,L2,L3. This is advantageous for ensuring that the film portion in contact with the wiping element is substantially static with respect to the surface S of the toner. This is also advantageous for increasing the adhesion of said portions 6,7 with the surface, whereby preventing any risk of tearing of the wiping element during the tearing operation of the central portion.

A cardboard support 8 is provided with adhering means. Said support is attached to the face 1B of the film, while not covering the wiping element W. Said cardboard is suitable for facilitating the placement of the sealing film 1 on the surface S to be sealed, after removal of the siliconized paper or protection sheet 5. Said support is removed after the placement of the sealing film 1.

Figure 4:
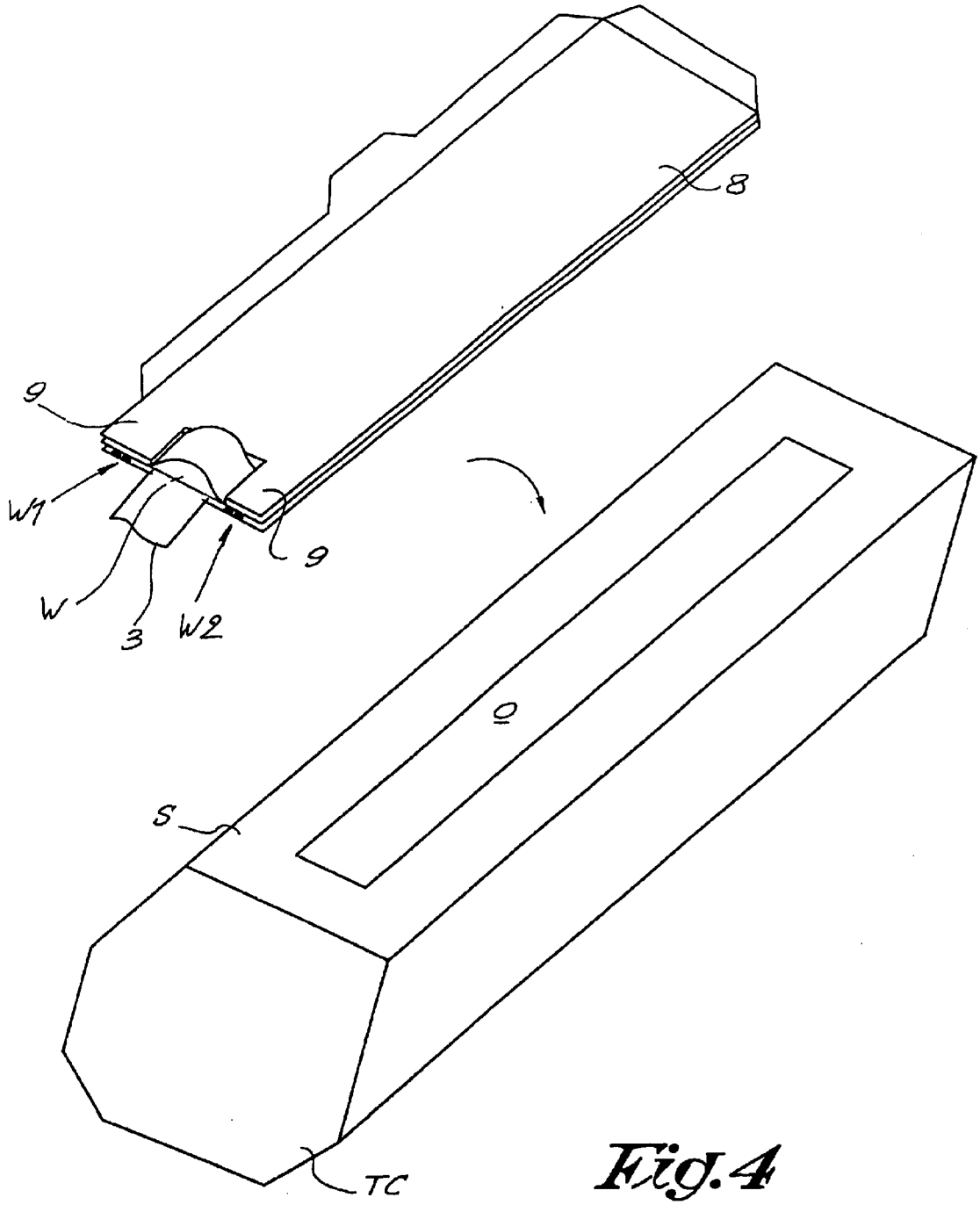
FIG. 4 is a view of an embodiment similar to the sealing member of FIG. 1.

FIG. 4 shows the placement of a sealing film 1 similar to the sealing film 1 of FIG. 1. The sealing film is provided with a removable support 8 (such as in cardboard) having at least a portion supporting or rigidifying a portion of the sealing film 1, and at least portions (such as the arms 9) for supporting or rigidifying the welded portions W1,W2 of the wiping element W.

Figure 5:
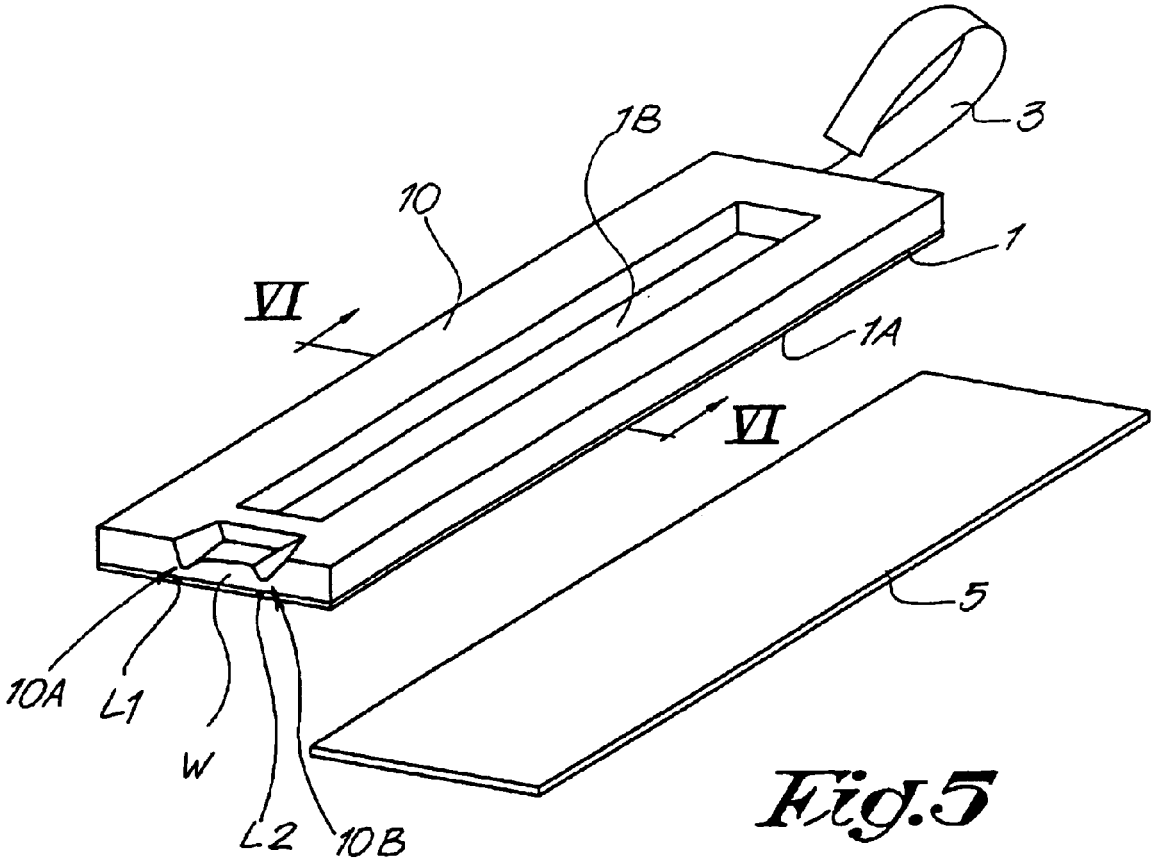
FIG. 5 is an exploded perspective view of another embodiment of the invention.
Figure 6:
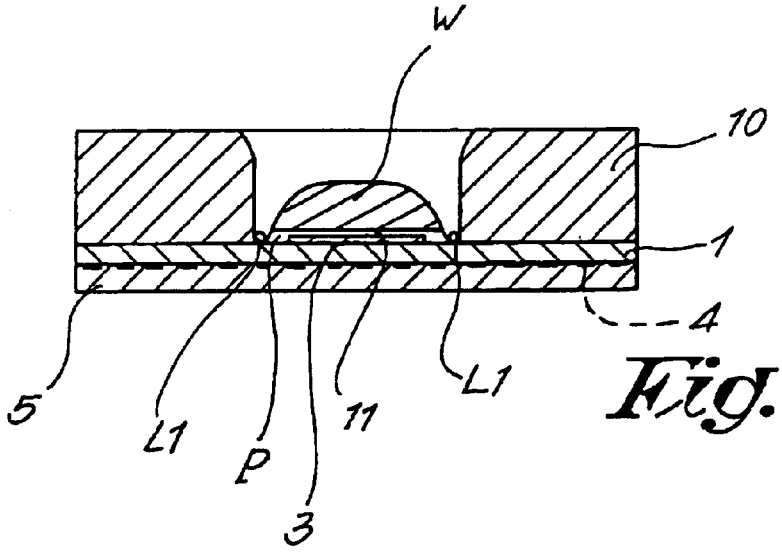
FIG. 6 is a cross section view along the line VI—VI of FIG. 5

FIG. 5 is an exploded view of a sealing member comprising a sealing film 1 and a slotted foam layer 10 attached to the face 1B of the sealing film 1. Two portions 10A, 10B of the slotted foam layer are welded to the sealing film 1 (for example welding lines L1). An antiadhesive layer 11 is attached to the foam layer at the place where a passage P has to be formed between the foam layer 10 and the film 1, for the pulling means and/or the torn central strip CS.

Due to the welding made under pressure, the portion of the foam between the welding lines L1 is compressed and forms a wiping element W.

Figure 7:
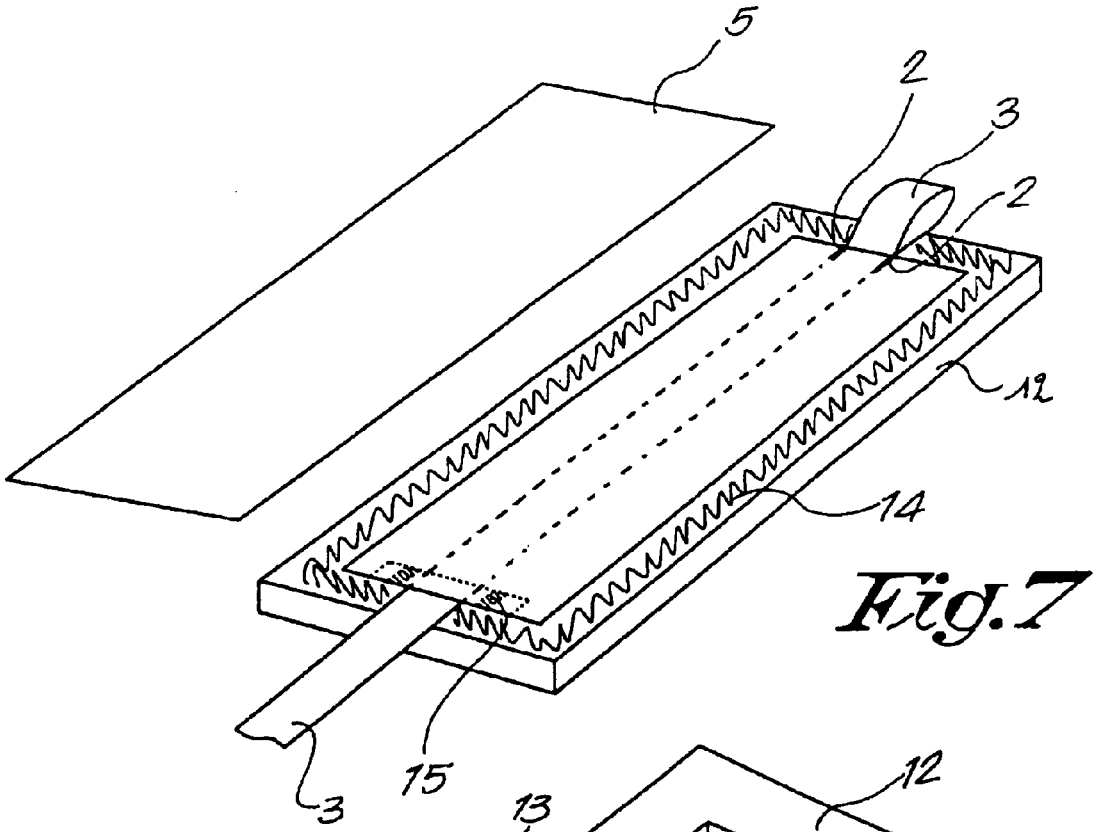
Figure 8:
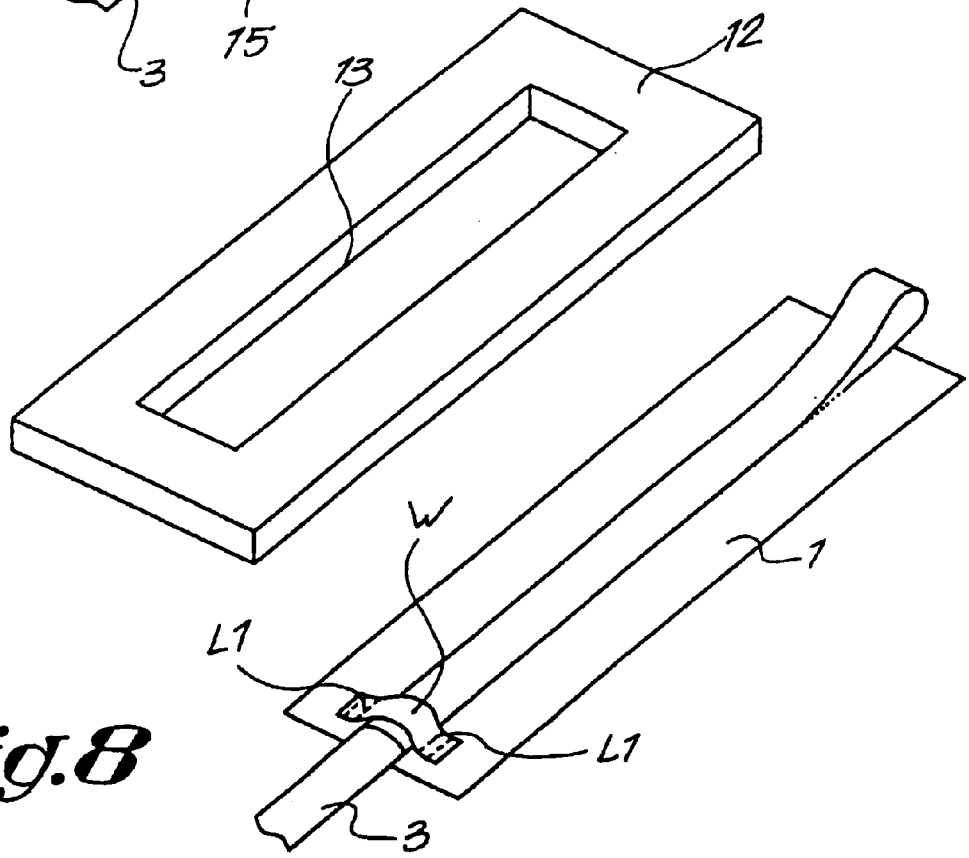
FIG. 8 is an exploded view of components of said embodiment of FIG. 7.

FIG. 7 shows a slotted foam layer 12 having dimension greater than the dimension of the sealing film 1, whereby the slot 13 can be sealed or closed by the film 1. Glue or adhesive 14 is provided along the edges of the foam 12 for attaching said foam on the surface of the toner container to be sealed. The wiping element W is welded to the film 1 so that when the film 1 seals the slot 13, the wiping element is at least partly (preferably only partly) within the space defined by the slot 13 when the foam is not compressed. The film portions 6,7 which are welded to the wiping element W are provided with adhesive 15 for attaching said portions to the surface S of the container.

FIGS. 9 to 11 show schematically the welding of a cleaning element W on a sealing film 1. The cleaning element W is made of an elastic and compressible material, such as an elastic sponge. The maximum elasticity can vary from a possible elastic stretching ST (with respect to the length LW in unstretched condition of the wiping element) of a few % (such as 5%, 10%, 20%, 30%, 50%, etc.) up to elastic stretching of more than 100%.

The wiping element W is thus first stretched with respect to the sealing film 1 and is applied on the sealing film.

Welding lines L1,L2,L3 are then formed between the wiping element W and the film 1, so as to define a passage P.

Figure 14:
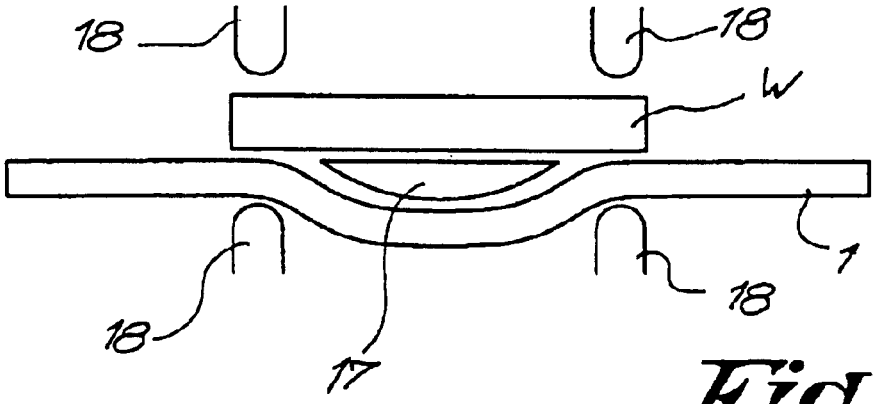
FIGS. 14 and 15 show schematically the manufacture of still another embodiment.
Figure 15:
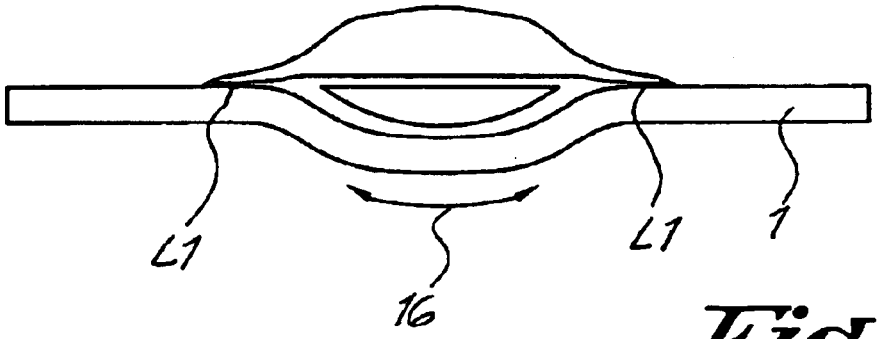

Instead of stretching the wiping element, it is possible to increase the length 16 of the film portion between two welding lines L1 (for example by folding a part of the film) before the welding operation by means of the welding heads 18. (see FIGS. 14 and 15) Said increase of length can be obtained by placing an element 17 between the compressible wiping element W and the film, so as to deform or fold the film during the welding operation.

Thereafter the element 17 is removed, so that when the film 1 is attached to the surface to be sealed, the film exerts a supplemental transversal stretching in the wiping element W.

In the method of welding of FIGS. 12 and 13, a compressible element W is provided with a welding layer 29, which is contacted with the face 1B of the film 1. The welding layer 29 is used for making the welding zone 20, defining there between the passage P. The compressible element is made of a foam with open cells, whereby during the welding operation, part of the welding layer 29 is smelted so that material of the welding layer flows within the foam, so as to maintain in compressed state the foam at the welding zone 30.

FIG. 16 is a view of a sealing member similar to the sealing member of FIG. 1, except that the cleaning element W is covered by a film 19 made of a material weldable to the film 1, for example the film 1 and the film 19 are made of the same material. The film 19 can for example be portions of waste strips obtained when cutting the film 1 with the pulling means in large film. The lateral portions of the film 19 are welded to the sealing film 1. The welding portions 6,7 of the film 1 are not provided with glue or adhesive 4 for attaching said portions 6,7 on the surface of the toner container to be sealed.

The manufacture of this embodiment can be made as follows:

The sealing film 1 is placed on a table 20 provided with a movable welding head 21 with a recess 22 defining a groove (the central portion of the recess has a greater depth that the edges of the recess).

The pulling means 3 is place above the sealing film 1.

The compressible material (such as a foam) W is placed above the pulling means 3 and the film 1.

The film 19 is placed above the cleaning element W, and the welding head 21 is moved towards the table 20 (arrow Z), so as to compress the cleaning element W and so as to weld the films 1 and 19 together at the welding zones 6,7.

Figure 19:
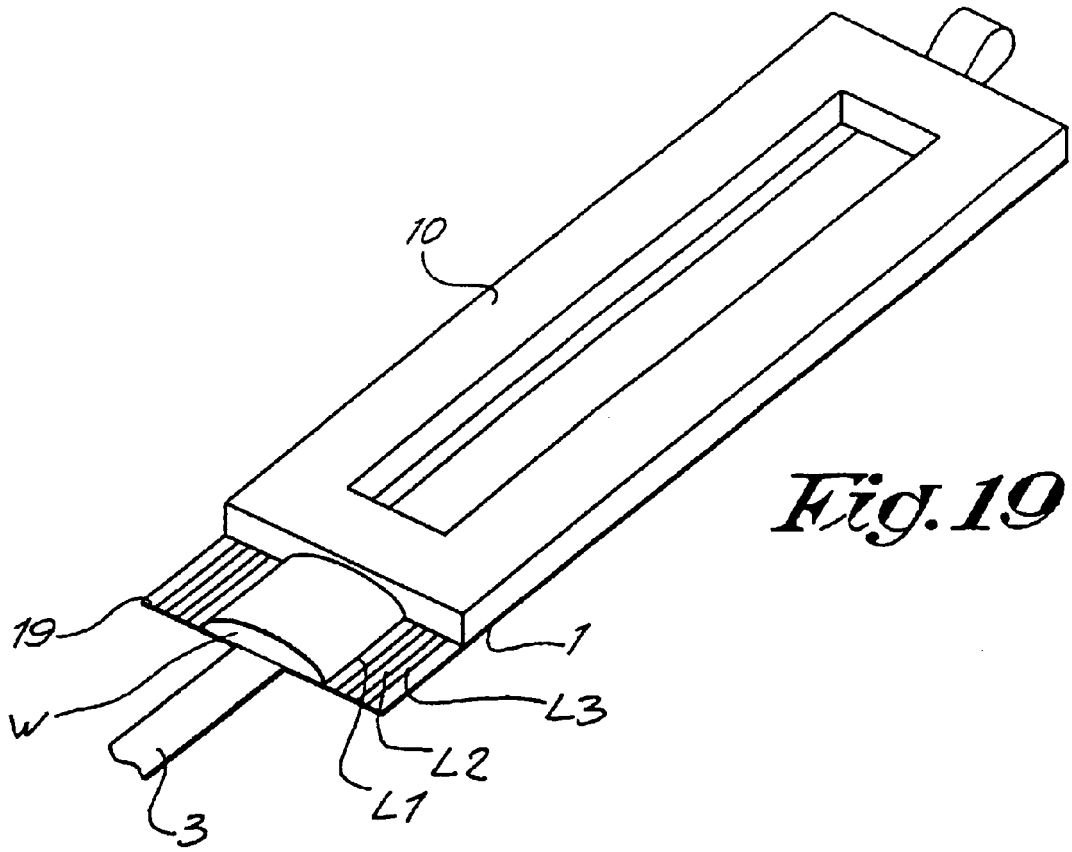
FIGS. 19 and 20 are perspective views of embodiments similar to the embodiment of FIG. 16.

The embodiment of FIG. 19 is similar to the embodiment of FIG. 16, except that the sealing film 1 is associated to a slotted foam layer 10.

Figure 20:
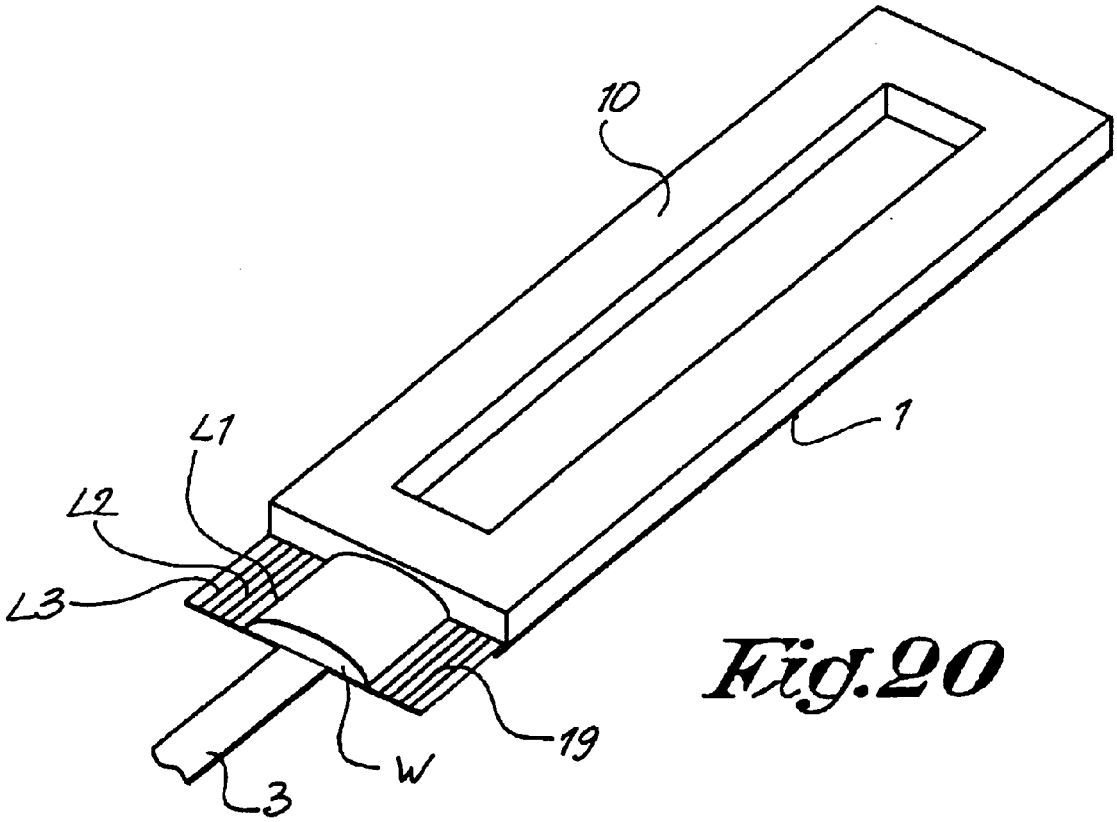

The embodiment of FIG. 20 is similar to the embodiment of FIG. 19, except that the wiping element W and the film 19 extend partly outside the sealing film 1.

Figure 21:
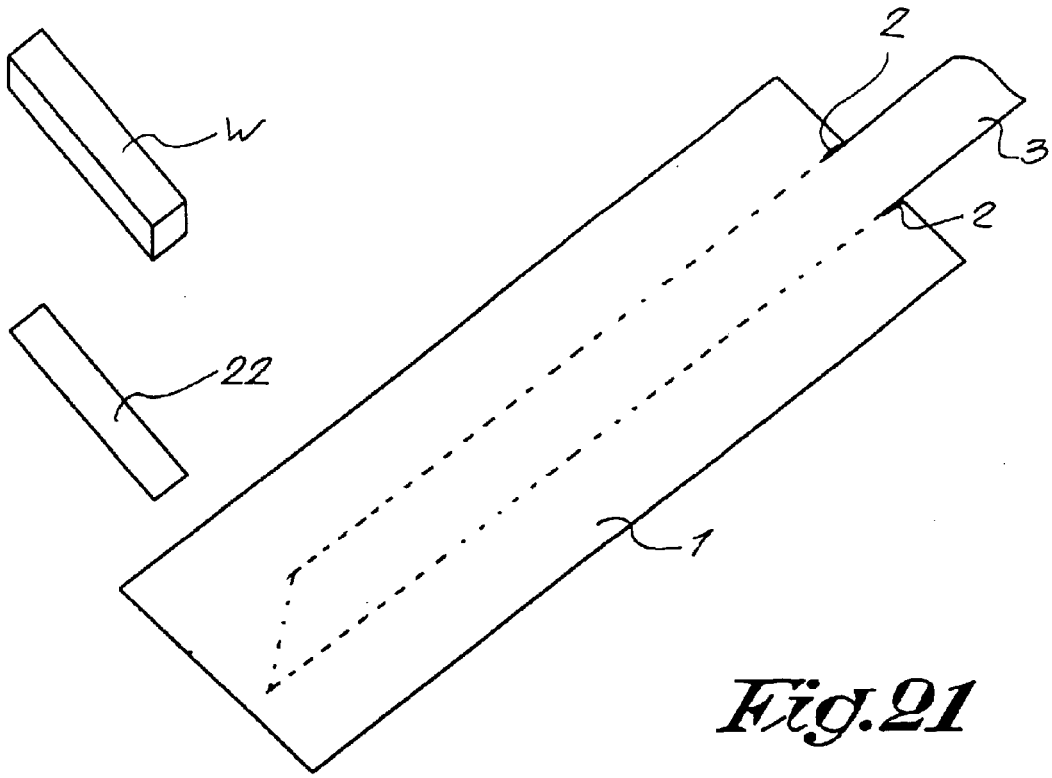
FIG. 21 is an exploded view of a step for the preparation of a sealing member of the invention.
Figure 22:
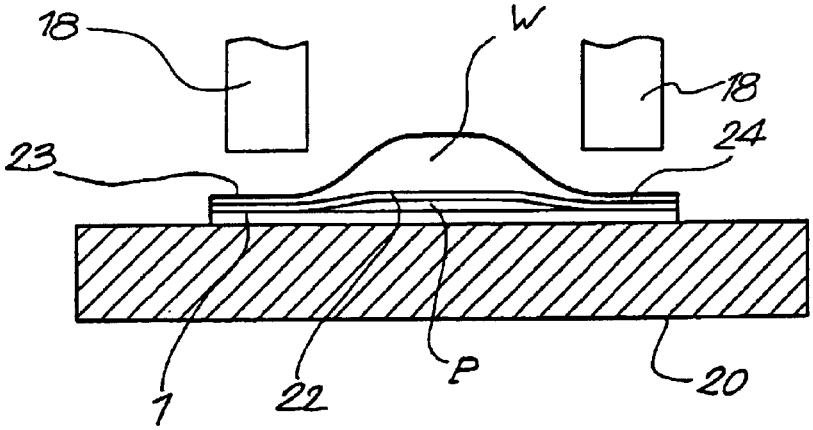
FIG. 22 shows the welding of the components of FIG. 21.

In FIG. 21, the sealing film 1 is first associated to an intermediate layer 22 for example made of a material compatible for making a welding between the film 1 and the layer 22 and a welding between the layer 22 and the foam W, said foam being not compatible as such for welding with the film 1. The foam is for example made in a thermoformable material, i.e. a shape can be given to the foam by heat treatment. When moving the welding head 18 towards the table 20, the foam edges 23,24 are compressed and heated, whereby said edges are transformed in a sheet shape. A welding is also obtained between the intermediate layer 22 and the film 1 and between the intermediate layer 22 and the sheet shaped edges 23,24.

Figure 23:
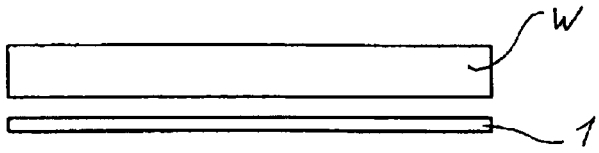
FIGS. 23 and 24 are schematic process steps for the welding of the wiping element.
Figure 24:
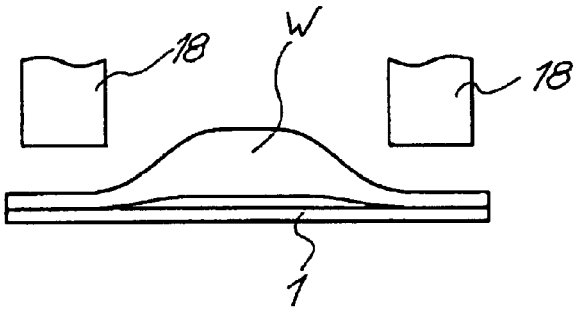

FIGS. 23 and 24 show the preparation of a sealing member made from a film 1 and a wiping element W which are compatible for welding, for example by heat welding by welding head 18.

Figure 25:
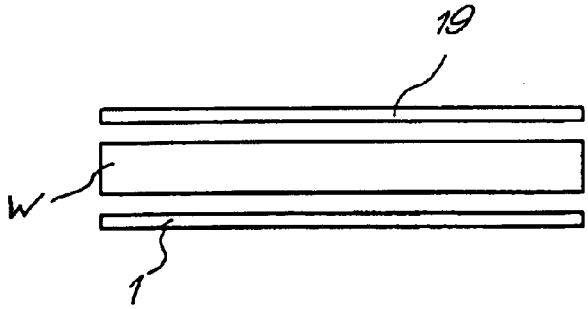
FIGS. 25 and 26 are schematic process steps for ensuring the attachment of the wiping element on the sealing film.
Figure 26:
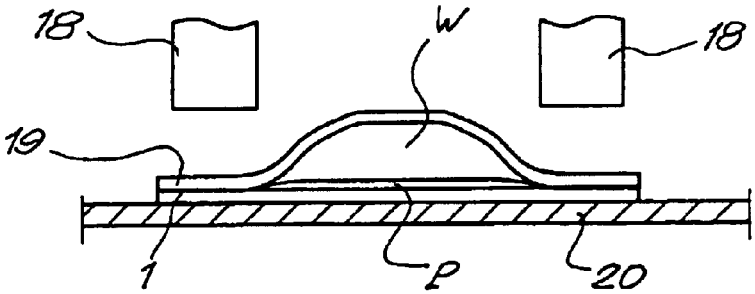

In the embodiment of FIG. 25, the wiping element W is made of a compressible foam with open cells, said wiping element being placed between the sealing film 1 and a cover film 19 which are compatible for welding. During the movement of the welding head 18, the wiping element W is compressed and the films 1 and 19 are partly melted, whereby materials of said films flow into the compressed foam W, so as to form a welding extending in the foam.

Figure 27:
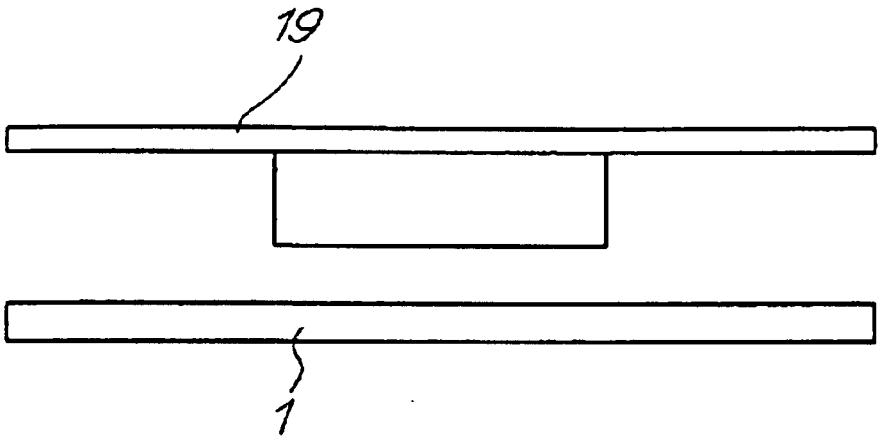
FIGS. 27 and 28 are process steps similar to the steps of FIGS. 25 and 26.
Figure 28:
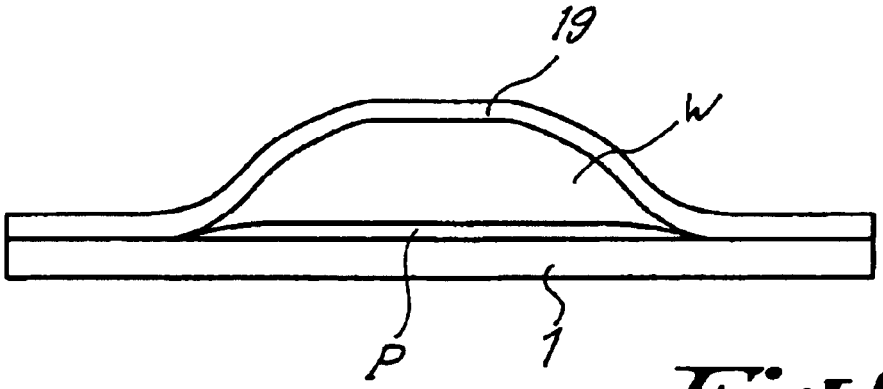

In the embodiment of FIG. 27, the wiping element W is first glued on the film 19. Thereafter the film 19 is welded to the sealing film 1.

Figure 29:
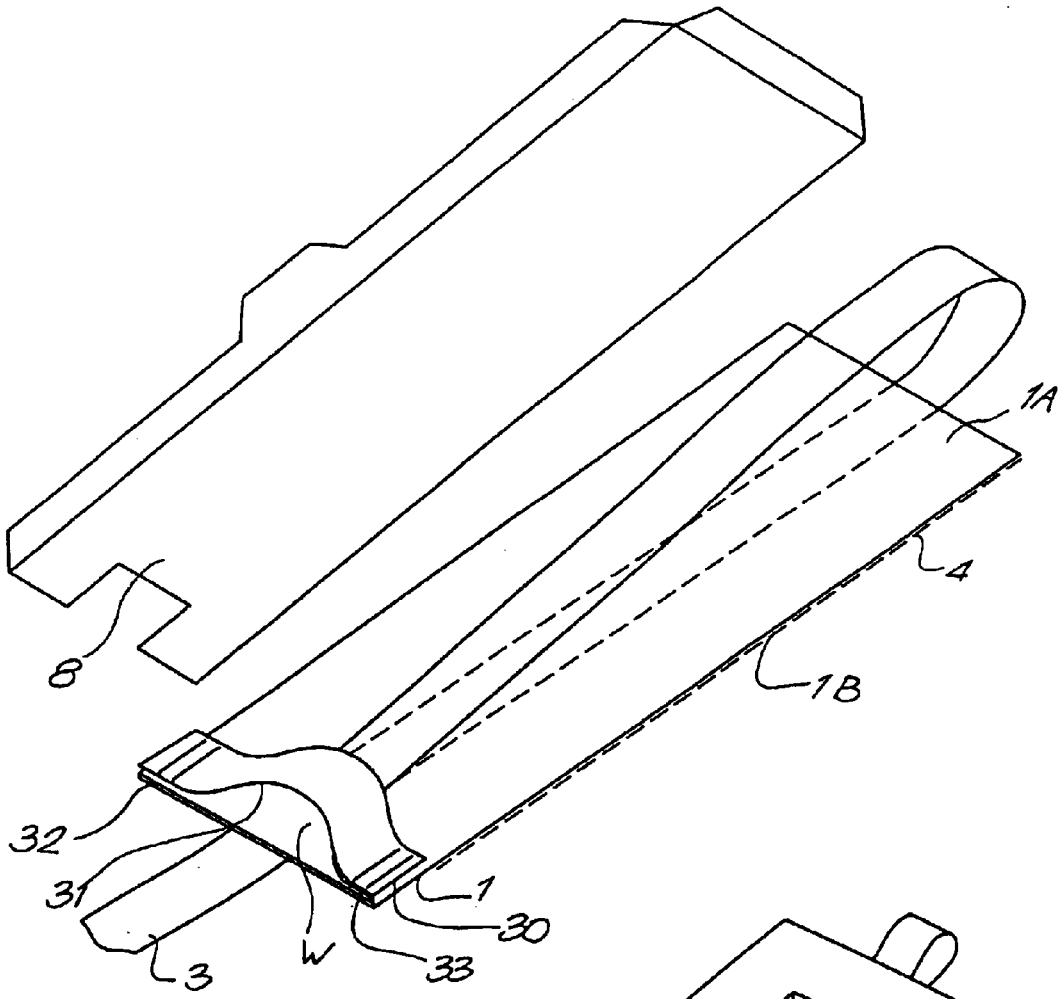
FIG. 29 is a perspective view of an embodiment similar to the embodiment of FIG. 1.

The embodiment of FIG. 29 is similar the embodiment of FIG. 1, except that the wiping element W is attached to the sealing film by means of staples 30. For example the wiping element is provided with a covering sheet 31. The wiping element is made of compressible foam and is glued or not (preferably glued) along its lateral portions 32,33 on the sealing film 1. The staples 30 (for example two per lateral portions of the wiping element) ensure the compression of the foam at the lateral portions and make mechanical bonds between the sealing film 1, the lateral portions 32,32 and the cover sheet 31. The use of a cover sheet 31 is advantageous for ensuring a good distribution of the compression force, as well as for ensuring a better bond for the foam material. The cover sheet acts as a reinforcement element. The face 1B of the sealing film is provided with adhesive 4 for gluing the sealing film on a surface of a toner container. A removable cardboard support 8 is advantageously attached to the face 1A for facilitating the placement of the sealing film. After placement of the film on the surface, the support 8 is then removed.

Figure 30:
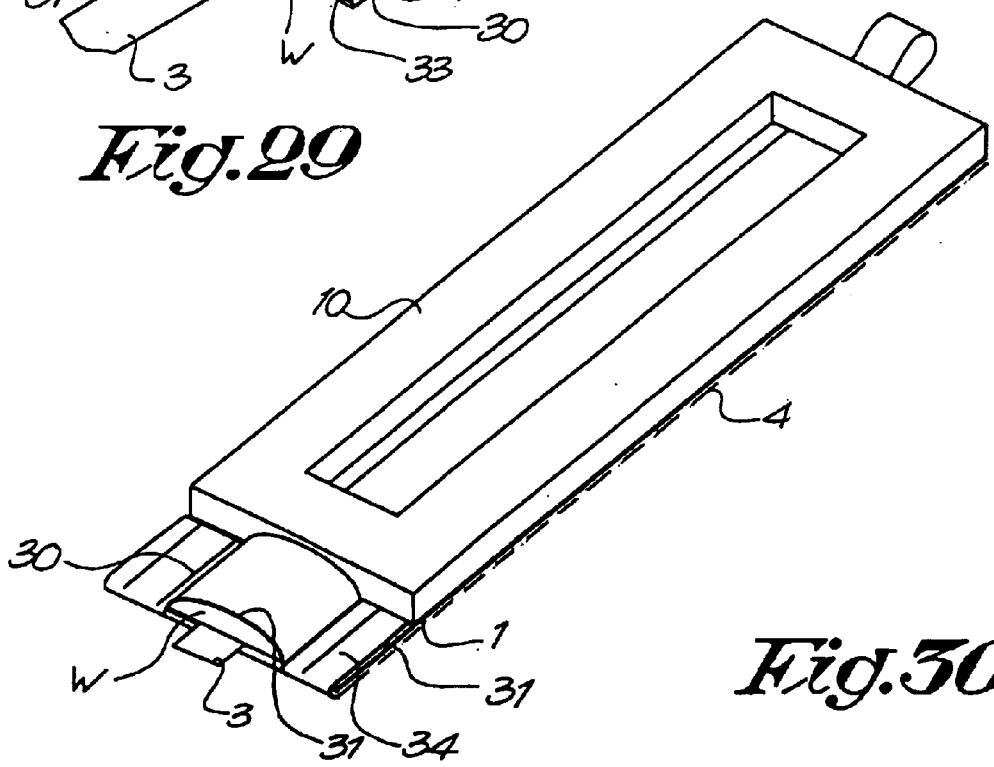
FIG. 30 is a view of an embodiment similar to the embodiment of FIG. 29.
Figure 31:
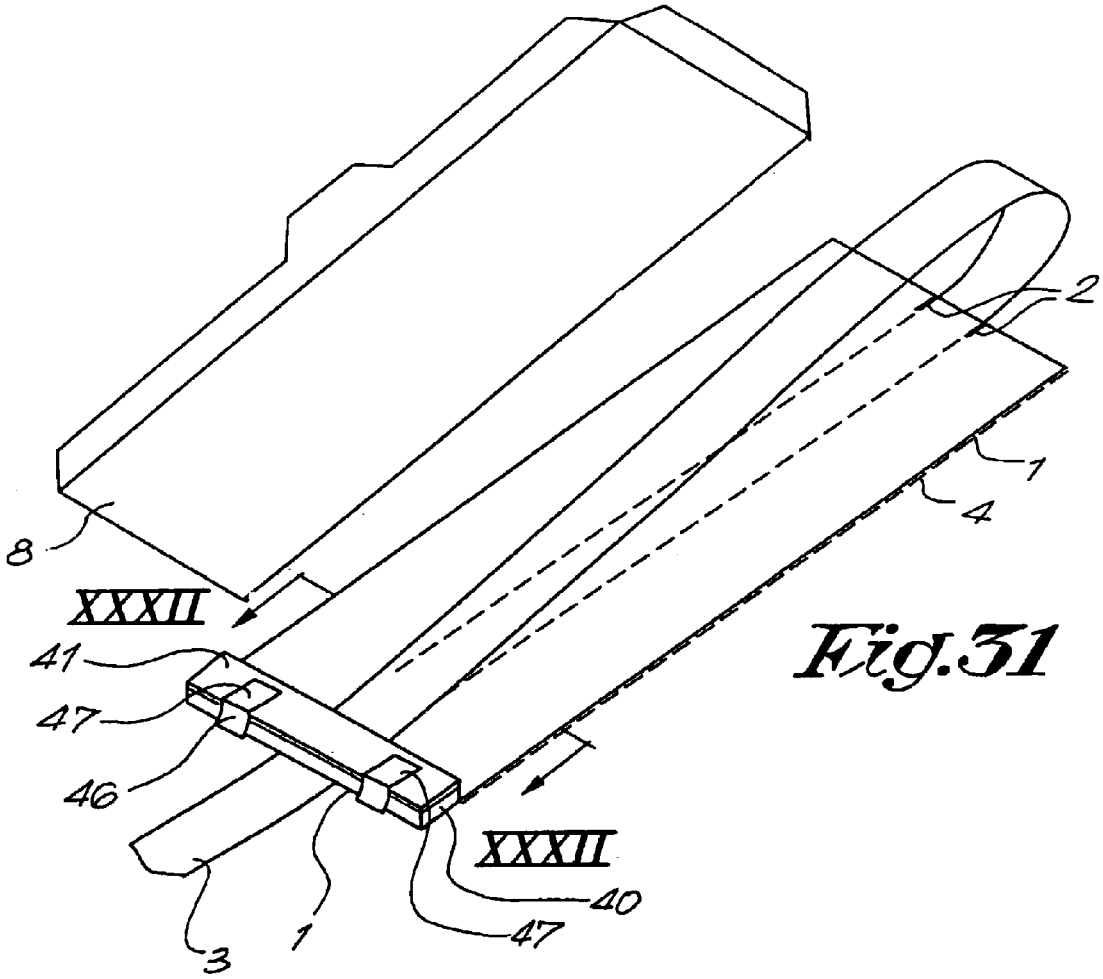
FIG. 31 is a perspective view of still a further embodiment.

The embodiment of FIG. 30 is similar to the embodiment of FIG. 29, except that a slotted foam layer 10 is attached to the sealing film 1, and that the lateral portions 32,33 of the wiping element are covered by the cover sheet 31, the latter being covered by two legs 34 of the sealing film 1 which are folded on the cover sheet 31. The staples bind the legs, the cover sheet 31, the compressible foam W and the sealing film 1 together. When using staples, the lateral portions 23,24 of the foam are rigidified.

Two staples are shown for binding purposes. It is obvious that a greater number of staples can be used, such as three, four, five, etc. Even for specific case, a single staple is sufficient for binding a lateral portion of the wiping element with the sealing film. Instead of using staples, it is also possible to use other mechanical means, such as seams, for example by sewing different points, along one or several lines, etc. Sewing is quite advantageous as it enables to use material made of the same material than the sealing film.

Figure 32:
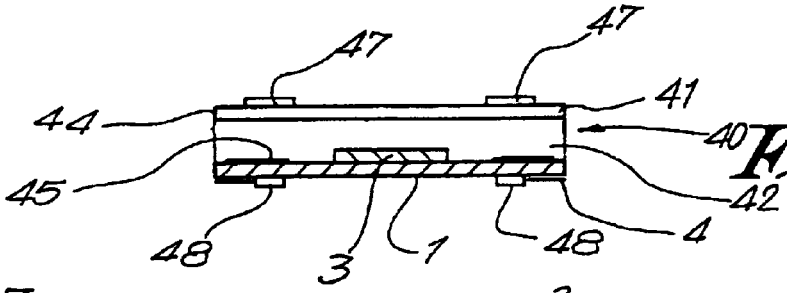
FIG. 32 is a cross section view of the embodiment of FIG. 31 along the line XXXII—XXXII.
Figure 33:
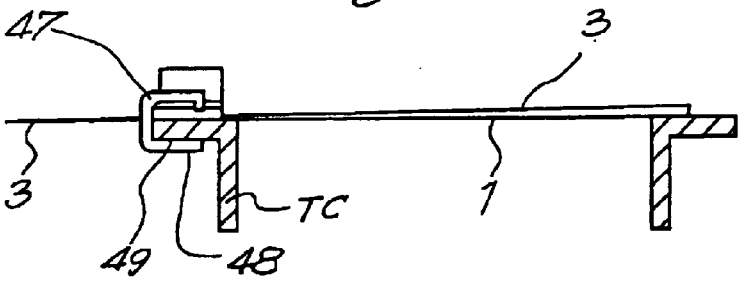
FIG. 33 shows schematically the compression of the foam element of the sealing member of FIG. 31.

The embodiment of FIG. 32 comprises a compressible foam bloc element 40 covered with a protection sheet 41. The protection sheet is glued on the foam element 40 (glue layer 44). The lateral portions 42 of the foam element are glued on the sealing film 1 (glue 45). The foam element is associated with two connecting elements 46 having a substantially U shape, said elements having each an upper blade 47 extending above the protection sheet 41 and ending with a pin entering the foam element 40, and a lower blade 48 extending below the sealing film 1. The blade 48 are not glued on the sealing film and are movable with respect to the sealing film 1.

When the sealing film is placed for sealing the container TC, the blades 48 are placed under a surface of a protruding part 49 of the container, whereby compressing the foam portion comprised between the upper and lower blades.

Figure 34:
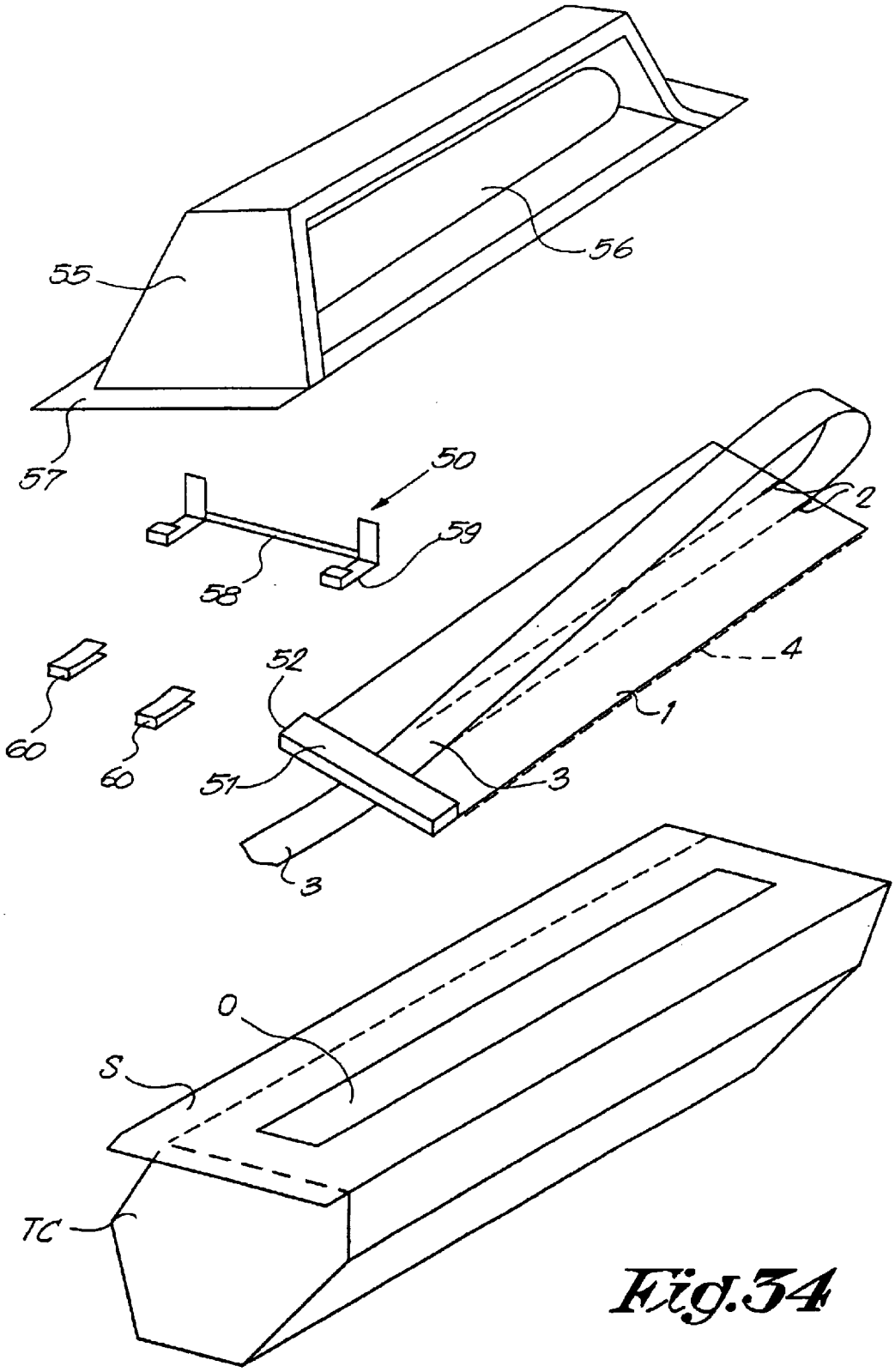
FIG. 34 is an exploded view of a specific toner container of the invention.
Figure 35:
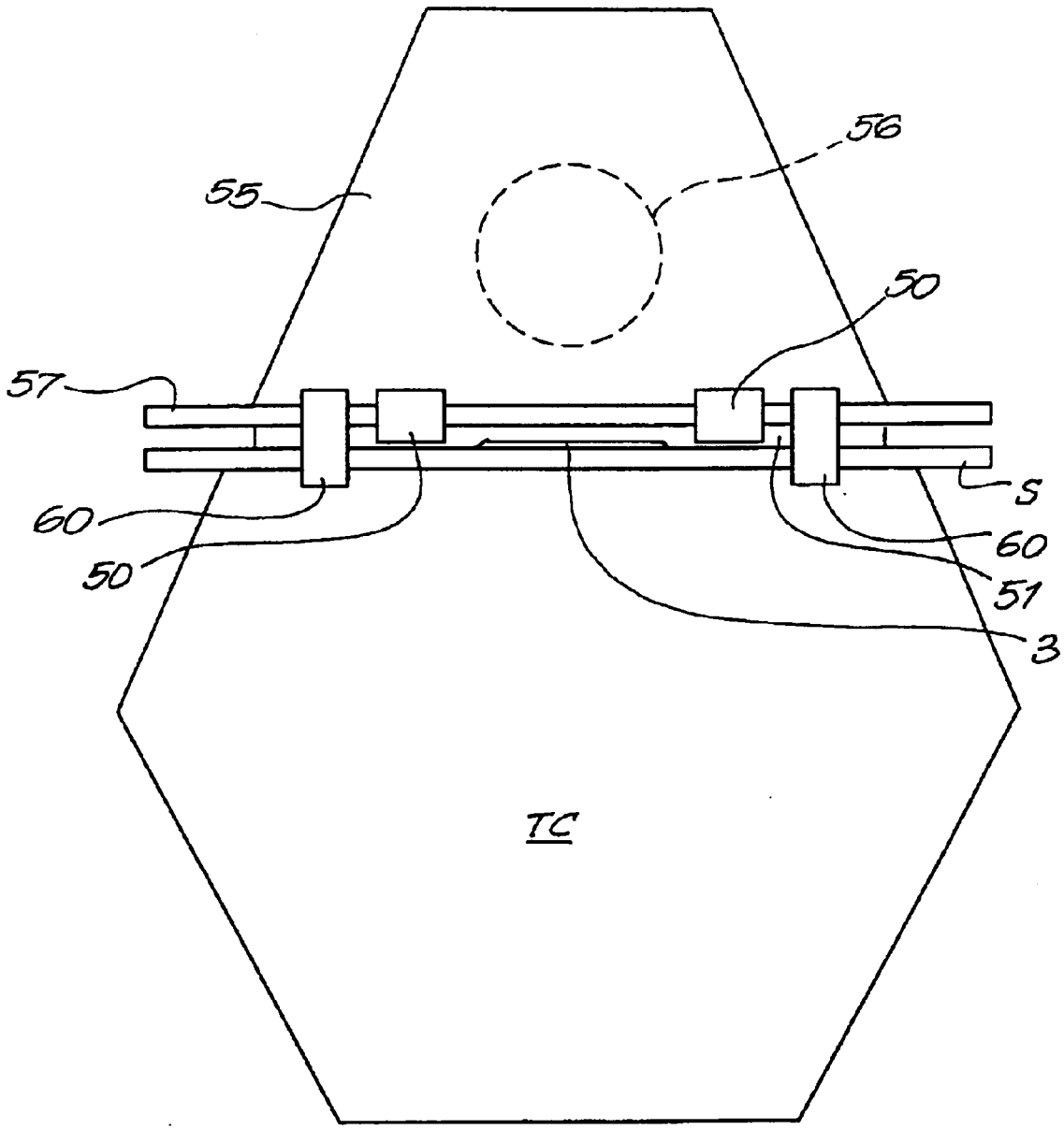
FIG. 35 is a side view of the toner container of FIG. 34.

FIG. 34 is a view of an toner cartridge which can be provided with elements 50 for ensuring a compression of the compressible foam bloc 51 glued along its lateral edges 52,53 to the sealing film 1, whereby the pulling means 3 extends between the glued edges of the foam 51 and between the foam 51 and the film 1.

The toner cartridge comprises a container TC with a surface S provided with the opening O on which the sealing film is glued (glue layer 4), and a support 55 for a magnetic roller 56, with protruding surfaces 57. The elements 50 have a form adapted for clipping on a surface 57 of the support 55, and are advantageously connected the one to the other by a blade or rod 58 for ensuring a predetermined distance between the element 50. The elements have when placed on the support 55 a blade 59 forming a protrusion with respect to the surface 57 and directed towards the container TC. After placement of the sealing film 1 on the container TC, the support 55 provided with the elements 50 is placed above the container and is attached by clipping systems 60 or other means pressing the surface 57 towards the container.

Figure 36:
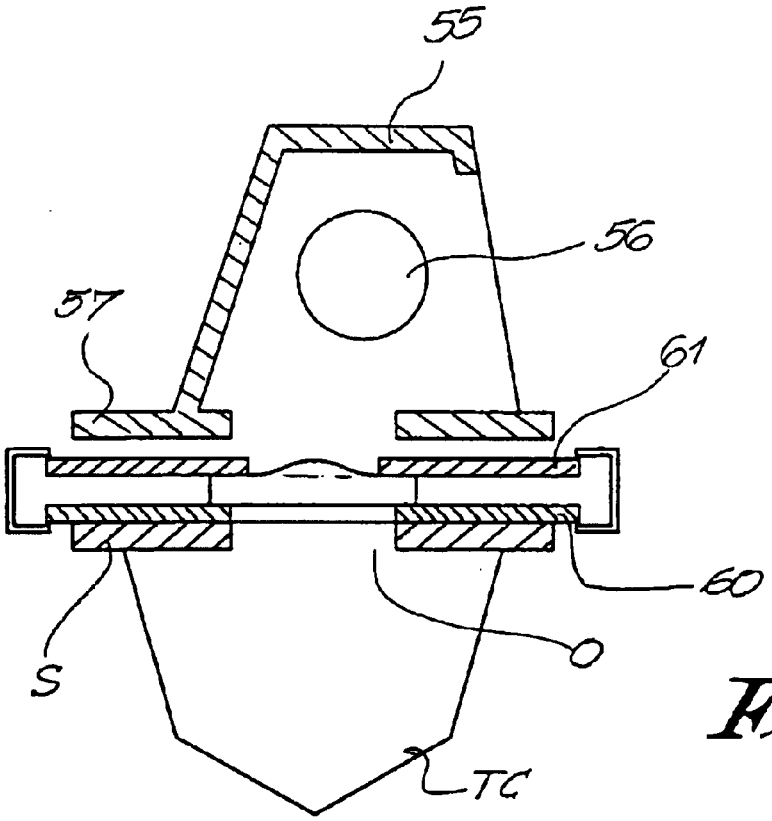
FIG. 36 is a schematic view of a toner cartridge with a mechanical system for compressing the lateral portion of the cleaning foam.
Figure 37:
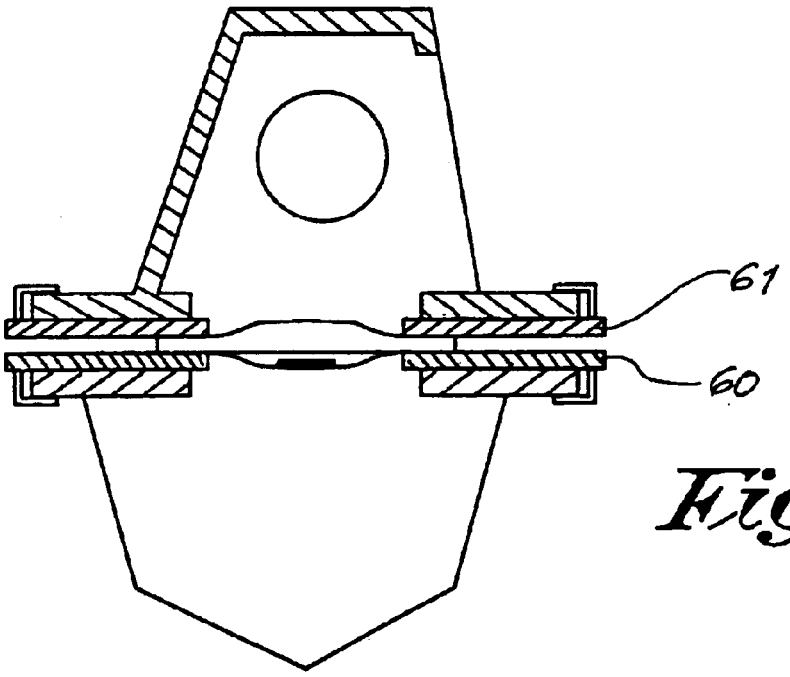
FIG. 37 is a view similar to FIG. 36, but after compression of the cleaning foam.
Figure 38:
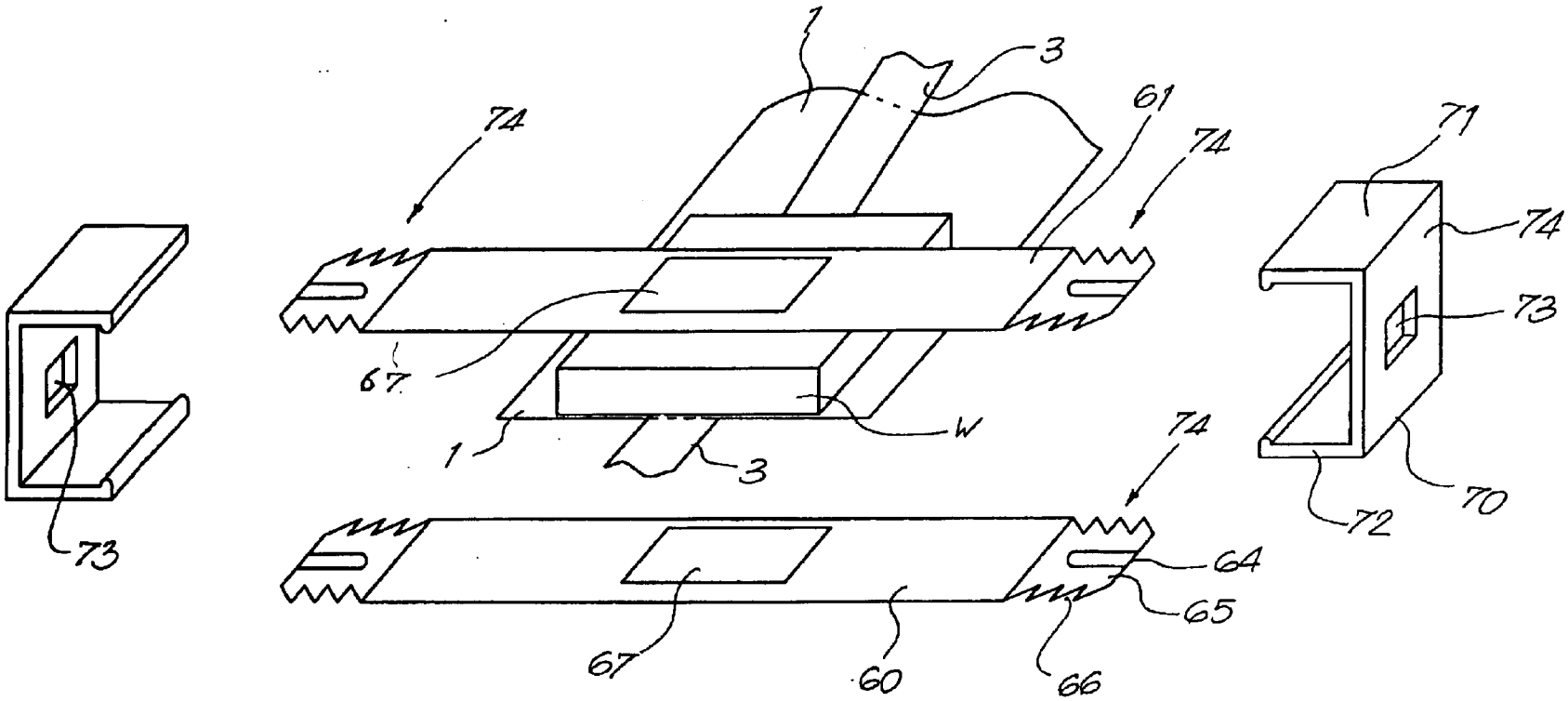
FIG. 38 is a perspective schematic view of a possible mechanical system.

In FIG. 36, a toner cartridge is schematically shown. This toner cartridge comprises a toner container TC with a surface S with the opening O for the passage of toner, and a support 55 for a roller 56, said support having a surface 57 intended to be pressed towards the surface S. The toner container is provided with a blade 60 for example glued on the surface S, while the support 55 is also provided with a blade 61 for example glued on the surface 57. The sealing film 1 with the compressible foam W is placed on the toner container, so that the portion of the sealing film contacting the wiping foam W is at least partly above the blade 60. The support 55 is placed so that the blade 61 covers at least partly the wiping element W.

The blades 60,61 have a length sufficient for extending partly outside the surfaces 57 and S. The ends 74 of the blades 60,61 are provided with a cut 64 defining two arms 65 provided with lateral teeth 66. The blades 60,61 are also provided with a central opening 67, with an open section lower than the upper section of the foam W. The pressing of the lateral portions of the wiping foam is obtained by connecting pieces 70 provided with an upper leg 71 adapted for contacting the surface 57, an lower leg 72 adapted for contacting the surface S, and an opening 73 in the central portion 74 connecting the legs. The opening 73 is adapted for receiving one end 74 of the blade 60 and one end 74 of the blade 61. When portions of the surface 57 and of the surface S are located between the two legs 71,72 of the connecting piece 70, a pressure is exerted whereby the foam W is compressed between the blades 60,61. The blades 60,61 ensure then also a connection between two opposite connecting pieces, whereby preventing any accidental removal of the connecting pieces, and whereby ensuring a correct pressing of the foam element W.

The teeth of the arms 65 and the cut 64 between two adjacent arms 65 are suitable for enabling to push the connecting pieces so that the arms 65 of the end of the blade 60, and the end of the blade 31 enter into the opening 73 of a connecting piece 70. The teeth are advantageously adapted for preventing any movement of the connecting piece away from the blades.

It is obvious that other mechanical means can be used. For example, a first blade is glued on the toner container, while the other is mounted rotatable with respect to said first blade, so that after pivoting the blade towards the first blade, the foam element is pressed between the two blades. A connecting piece, possibly attached to one blade, is then sufficient for maintaining the pressing position of the blades for the foam.

What we claim is:

1. A sealing member for sealing an opening of a surface of a toner container for laser printers, copy machines and fax machines, said sealing member comprising:

a sealing film with a first face intended to be directed towards the surface for sealing the opening of the toner container and a second face opposite to said first face, said film comprising a longitudinal central strip intended to be torn off, said central strip extending from a first end up to a second end and having a substantially predetermined width, a wiping element for wiping the portion of the first face of the sealing film corresponding to the central strip when contacting the torn central strip with the wiping element, a pulling member bound to the first end of the central strip, said pulling member being intended to extend before the tearing off of the central strip at least partly above the second face of the sealing film, in which the wiping element is attached to a component selected from the group consisting of the sealing film, a foam layer attached to the sealing film, a non foam support attached to the sealing film, and combinations thereof, by at least a connecting means selected from the group consisting of:

the combination of at least a first welding and a second welding, connecting element attached to the component by a first welding and a second welding, two distinct connecting elements, a first of which is attached to the component by a first welding, while the second is attached to the component by a second welding, two distinct connecting elements, a first of which is attached to a first component by a first welding, while the second is attached to another component by a second welding, and combinations thereof, whereby the first welding and the second welding are distant from each other so as to define there between a passage for the torn central strip.

2. The sealing member of claim 1, in which the wiping element has a first portion and a second portion which are welded to the component so as to define between said portions a passage with a width at least substantially equal to the predetermined width of the central strip.

3. The sealing member of claim 1, which is provided with a means adapted for creating at least a relative transverse tension between the component and the wiping element when the sealing film seals the opening of the toner container.

4. The sealing member of claim 1, in which the wiping element is attached to the component at least by means of two welding lines, said welding lines forming guiding means for the torn central strip during its tearing.

5. The sealing member of claim 1, in which the wiping element is made of a material selected from the group consisting of weldable materials, materials provided with at least one weldable layer, solvent soluble materials, materials provided with solvent soluble layer, reacting materials and materials provided with a reactive layer.

6. The sealing member of claim 1, in which the sealing film is made of weldable materials, materials provided with at least one weldable layer, solvent soluble materials, materials provided with solvent soluble layer, reacting materials and materials provided with a reactive layer.

7. The sealing member of claim 1, in which the wiping element is made of a compressible material, said wiping element having a first wiping portion adjacent to the first welding and a second wiping portion adjacent to the second welding, whereby said first and second wiping portions are compressed.

8. The sealing member of claim 7, in which the wiping element comprises a third wiping portion located between the first and second wiping portions, said third wiping portion being less compressed with respect to the first and second wiping portions.

9. The sealing member of claim 1, in which the wiping element comprises a compressible foam layer, said foam layer having a first portion and a second portion welded to the sealing film in a compressed state.

10. The sealing member of claim 1, in which the sealing film and the wiping element are welded together and are made of compatible thermoplastic materials.

11. The sealing member of claim 1, in which the first face of the sealing film is provided with an adhesive layer for attaching the sealing film on the surface of the container to be sealed, whereby at least the first face of the portions of the film attached by the first welding and the second welding to the wiping element are provided with adhesive for attaching said portion on the surface of the container to be sealed.

12. The sealing member of claim 1, in which the first face of the sealing film is provided with an adhesive layer for attaching the sealing film on the surface of the container to be sealed, whereby at least the first face of the portions of the film attached by the first welding and the second welding to the wiping element are at least partly not provided with adhesive for attaching said portion on the surface of the container to be sealed.

13. The sealing member of claim 1, in which the wiping element is selected from the group consisting of foam element, wiper, felt, antistatic layer, friction reducing layer, material releasing friction reduction agent, material releasing antistatic agent, releasing layer, magnetic material and combinations thereof.

14. The sealing member of claim 1, in which the first and second weldings are selected from the group consisting of hot welding, cold welding, reactive welding, solvent welding and combinations thereof.

15. The sealing member of claim 1, in which the sealing film is provided with gluing means for attaching the sealing film on the surface of the container with the opening to be sealed.

16. The sealing member of claim 1, in which the sealing film is provided with at least one foam element.

17. The sealing member of claim 1, in which the sealing film is provided with at least one foam element, said foam element being provided with gluing means for attaching the sealing member to the surface of the container with the opening to be sealed.

18. The sealing member of claim 1, in which the torn central strip has two substantially parallel longitudinal edges defining there between a width, and in which the first and second weldings are distant from each other from a distance corresponding to less than 120% of the width of the central strip.

19. The sealing member of claim 1, in which the first welding and second welding are substantially parallel welding lines.

20. The sealing member of claim 1, which is associated to a means for ensuring at least a transversal stretching of the wiping element, when the sealing film seals the opening of the toner container.

21. The sealing member of claim 1, in which the first and second weldings are weldings between the sealing film and intermediate elements bound to the wiping elements.

22. The sealing member of claim 1, which is further provided with at least one support means for facilitating the placement of the sealing member.

23. The sealing member of claim 1, which is further provided with at least one cardboard support for facilitating the placement of the sealing member, said cardboard support being attached to the second face of the sealing film.

24. The sealing member of claim 1, in which the wiping element extends at least partly outside the sealing film.

25. The sealing member of claim 1, in which the wiping element is covered at least partly by a connecting element attached to the sealing film by a first welding and by a second welding distant from each other so as to define there between a passage for the torn central strip.

26. The sealing member of claim 25, in which the connecting element is selected from the group consisting of films weldable to the sealing film, and layers bound to the wiping element and which are weldable to the sealing film.

27. The sealing member of claim 1, in which the wiping element is covered at least partly by a weldable film, said film having a first portion and a second portion which are welded to the sealing film so as to define between said portion a passage with a width at least substantially equal to the predetermined width of the central strip.

28. The sealing member of claim 1, in which the wiping element is attached to the connecting means by at least one bond selected from the group consisting of welding points, welding lines, welding zones, adhesives, seams, mechanical fixing elements, and combinations thereof.

29. The sealing member of claim 1, in which the wiping element is covered by a film having two distant portions contacting the sealing film and welded to the sealing film, and in which the sealing film is made of weldable materials, materials provided with at least one weldable layer, solvent soluble materials, materials provided with solvent soluble layer, reacting materials and materials provided with a reactive layer.

30. A toner container for laser printers, copy machines and fax machines, said toner container having a surface with an opening for the passage of the toner, said toner container being provided with a sealing member for sealing the opening, whereby the sealing member comprises:

a sealing film with a first face directed towards the surface for sealing the opening of the toner container and a second face opposite to said first face, said sealing film comprising a longitudinal central strip intended to be torn off, said central strip extending from a first end up to a second end and having a substantially predetermined width, a wiping element for wiping the portion of the first face of the sealing film corresponding to the central strip when contacting the torn central strip with the wiping element, a pulling member bound to the first end of the central strip, said pulling member being intended to extend before the tearing off of the central strip at least partly above the second face of the sealing film, in which the wiping element is attached to a component selected from the group consisting of the sealing film, a foam layer attached to the sealing film, a non foam support attached to the sealing film, and combinations thereof, by at least a connecting means selected from the group consisting of:

combination of at least a first welding and a second welding;

one connecting element attached to the component by a first welding and a second welding, two distinct connecting elements, a first of which is attached to the component by a first welding, while the second is attached to the component by a second welding, two distinct connecting elements, a first of which is attached to a first component by a first welding, while the second is attached to another component by a second welding, and combinations thereof, whereby the first welding and the second welding are distant from each other so as to define there between a passage for the torn central strip.

31. The toner container of claim 30, in which the wiping element has a first portion and a second portion which are welded to the component so as to define between said portions a passage with a width at least substantially equal to the width of the central strip.

32. The toner container of claim 30, in which at least a relative transverse tension is created between the component and the wiping element when the sealing film seals the opening of the toner container.

33. The toner container of claim 30, in which the wiping element is attached to the sealing film at least by means of at least two welding lines, said welding lines forming guiding means for the torn central strip during its tearing.

34. The toner container of claim 30, in which the wiping element is made of a material selected from the group consisting of weldable materials, materials provided with at least one weldable layer, solvent soluble materials, materials provided with solvent soluble layer, reacting materials and materials provided with a reactive layer.

35. The toner container of claim 30, in which the sealing film is made of weldable materials, materials provided with at least one weldable layer, solvent soluble materials, materials provided with solvent soluble layer, reacting materials and materials provided with a reactive layer.

36. The toner container of claim 30, in which the wiping element is made of a compressible material, said wiping element having a first wiping portion adjacent to the first welding and a second wiping portion adjacent to the second welding, whereby said first and second wiping portions are compressed.

37. The toner container of claim 36, in which the wiping element comprises a third wiping portion located between the first and second wiping portions, said third wiping portion being less compressed with respect to the first and second wiping portions.

38. The toner container of claim 30, in which the wiping element comprises a compressible foam layer, said foam layer having a first portion and a second portion welded to the sealing film in a compressed state.

39. The toner container of claim 30, in which the sealing film and the wiping element are made of compatible thermoplastic materials.

40. The toner container of claim 30, in which the first face of the sealing film is attached with an adhesive layer on the surface of the container, whereby at least the first face of the portions of the film attached by the first welding and the second welding to the wiping element are attached by adhesive on the surface of the container.

41. The toner container of claim 30, in which the first face of the sealing film is attached with an adhesive layer on the surface of the container, whereby at least the first face of the portions of the film attached by the first welding and the second welding to the wiping element are not glued on the surface of the container.

42. The toner container of claim 30, in which the wiping element is selected from the group consisting of foam element, wiper, felt, antistatic layer, friction reducing layer, material releasing friction reduction agent, material releasing antistatic agent, releasing layer, magnetic material and combinations thereof.

43. The toner container of claim 30, in which the first and second weldings are selected from the group consisting of hot welding, cold welding, reactive welding, solvent welding and combinations thereof.

44. The toner container of claim 30, in which the sealing film is provided with gluing means for attaching the sealing film on the surface of the container with the opening to be sealed.

45. The toner container of claim 30, in which the sealing film is provided with at least one foam element.

46. The toner container of claim 30, in which the sealing film is provided with at least one foam element, said foam element being provided with gluing means for attaching the sealing member to the surface of the container with the opening to be sealed.

47. The toner container of claim 30, in which the torn central strip has two substantially parallel longitudinal edges defining there between a width, and in which the first and second weldings are distant from each other from a distance corresponding to less than 120% of the width of the central strip.

48. The toner container of claim 30, in which the first welding and second welding are substantially parallel welding lines.

49. The toner container of claim 30, which is associated to a means for ensuring at least a transversal stretching of the wiping element, when the sealing film seals the opening of the toner container.

50. The toner container of claim 30, in which the first and second weldings are weldings between the sealing film and intermediate elements bound to the wiping element.

51. The toner container of claim 30, said toner container being a component of a toner cartridge.

52. The toner container of claim 30, in which the wiping element extends at least partly outside the sealing film.

53. The toner container of claim 30, in which the wiping element is covered at least partly by a connecting element attached to the sealing film by a first welding and by a second welding distant from each other so as to define there between a passage for the torn central strip.

54. The toner container of claim 53, in which the connecting element is selected from the group consisting of films weldable to the sealing film, and layers bound to the wiping element and which are weldableto the sealing film.

55. The toner container of claim 30, in which the wiping element is covered at least partly by a weldable film, said film having a first portion and a second portion which are welded to the sealing film so as to define between said portions a passage with a width at least substantially equal to the predetermined width of the central strip.

56. The toner container of claim 30, in which the wiping element is attached to the connecting means by at least one bond selected from the group consisting of welding points, welding lines, welding zones, adhesives, seams, mechanical fixing elements, and combinations thereof.

57. The toner container of claim 30, in which the wiping element is covered by a film having two distant portions contacting the sealing film and welded to the sealing film, and in which the sealing film is made of weldable materials, materials provided with at least one weldable layer, solvent soluble materials, materials provided with solvent soluble layer, reacting materials and materials provided with a reactive layer.

58. A sealing member for sealing an opening of a surface of a toner container for laser printers, copy machines and fax machines, said sealing member comprising:

a sealing film with a first face intended to be directed towards the surface for sealing the opening of the toner container and a second face opposite to said first face, said film comprising a longitudinal central strip intended to be torn off, said central strip extending from a first end up to a second end and having a substantially predetermined width, a wiping element for wiping the portion of the first face of the sealing film corresponding to the central strip when contacting the torn central strip with the wiping element, the wiping element having two lateral side portions and a central portion extending between said lateral portions, a pulling member bound to the first end of the central strip, said pulling member being intended to extend before the tearing off of the central strip at least partly above the second face of the sealing film, in which the wiping element is attached to a component selected from the group consisting of the sealing film, a foam layer attached to the sealing film, a non foam support attached to the sealing film, and combinations thereof, by at least one connecting means for ensuring a pressure between the lateral portions of the wiping element and the component, whereby a passage is defined between said lateral portions of the wiping element, and between the central portion of the wiping element and the component.

59. The sealing member of claim 58, in which the connecting means exert a pressure between the lateral portions of the wiping element and the component sufficient for forming guiding means for torn central strip during its tearing.

60. The sealing member of claim 58, in which the connecting means exert a pressure between the lateral portions and the component which is greater than the pressure of the central portion of the wiping element and the component.

61. The sealing member of claim 58, in which the connecting means is adapted for preventing the tearing off of the wiping element during the tearing of the central strip.

62. The sealing member of claim 58, in which the sealing film is provided with gluing means for attaching the sealing film on the surface of the container with the opening to be sealed.

63. The sealing member of claim 58, in which the sealing film is provided with at least one foam element.

64. The sealing member of claim 58, in which the sealing film is provided with at least one foam element, said foam element being provided with gluing means for attaching the sealing member to the surface of the container with the opening to be sealed.

65. The sealing member of claim 58, which is associated to a means for ensuring at least a transversal stretching of the wiping element, when the sealing film seals the opening of the toner container.

66. The sealing member of claim 58, which is further provided with at least one support means for facilitating the placement of the sealing member.

67. The sealing member of claim 58, which is further provided with at least one cardboard support for facilitating the placement of the sealing member, said cardboard support being attached to the second face of the sealing film.

68. The sealing member of claim 58, in which the wiping element extends at least partly outside the sealing film.

69. The sealing member of claim 58, in which the wiping element is covered at least partly by a film element.

70. The sealing member of claim 58, in which the connecting means is a mechanical means acting at least between the lateral portions of the wiping element and the component.

71. A sealing member for sealing an opening of a surface of a toner container for laser printers, copy machines and fax machines, said sealing member comprising:

a sealing film with a first face intended to be directed towards the surface for sealing the opening of the toner container and a second face opposite to said first face, said film comprising a longitudinal central strip intended to be torn off, said central strip extending from a first end up to a second end and having a substantially predetermined width, a wiping element for wiping the portion of the first face of the sealing film corresponding to the central strip when contacting the torn central strip with the wiping element, the wiping element having two lateral side portions and a central portion extending between said lateral portions, a pulling member bound to the first end of the central strip, said pulling member being intended to extend before the tearing off of the central strip at least partly above the second face of the sealing film, in which the wiping element is attached to a component selected from the group consisting of the sealing film, a foam layer attached to the sealing film, a non foam support attached to the sealing film, and combinations thereof, by at least one connecting means adapted for ensuring when the sealing film seals the opening of the surface of the container, a pressure between the lateral portions of the wiping element and the surface with the sealed opening, while defining a passage between said lateral portions of the wiping element, and between the central portion of the wiping element and the component.

72. The sealing member of claim 71, in which the connecting means is adapted for exerting a pressure between the lateral portions of the wiping element and the component sufficient for forming guiding means for torn central strip during its tearing.

73. The sealing member of claim 71, in which the connecting means is adapted for exerting a pressure between the lateral portions and the component which is greater than the pressure of the central portion of the wiping element and the component.

74. The sealing member of claim 71, in which the connecting means is adapted for preventing the tearing off of the wiping element during the tearing of the central strip.

75. The sealing member of claim 71, in which the connecting means is a mechanical means acting at least between the lateral portions of the wiping element and the component.

76. The sealing member of claim 71, in which the sealing film is provided with gluing means for attaching the sealing film on the surface of the container with the opening to be sealed.

77. The sealing member of claim 71, in which the sealing film is provided with at least one foam element.

78. The sealing member of claim 71, in which the sealing film is provided with at least one foam element, said foam element being provided with gluing means for attaching the sealing member to the surface of the container with the opening to be sealed.

79. The sealing member of claim 71, which is associated to a means for ensuring at least a transversal stretching of the wiping element, when the sealing film seals the opening of the toner container.

80. The sealing member of claim 71, which is further provided with at least one support means for facilitating the placement of the sealing member.

81. The sealing member of claim 71, which is further provided with at least one cardboard support for facilitating the placement of the sealing member, said cardboard support being attached to the second face of the sealing film.

82. The sealing member of claim 71, in which the wiping element extends at least partly outside the sealing film.

83. The sealing member of claim 71, in which the wiping element is covered at least partly by a connecting element.

84. A toner container for laser printers, copy machines and fax machines, said toner having a surface with an opening for the passage of toner, said toner container being provided with a sealing member for sealing the opening, whereby the sealing member comprises:

a sealing film with a first face intended to be directed towards the surface for sealing the opening of the toner container and a second face opposite to said first face, said film comprising a longitudinal central strip intended to be torn off, said central strip extending from a first end up to a second end and having a substantially predetermined width, a wiping element for wiping the portion of the first face of the sealing film corresponding to the central strip when contacting the torn central strip with the wiping element, the wiping element having two lateral side portions and a central portion extending between said lateral portions, a pulling member bound to the first end of the central strip, said pulling member being intended to extend before the tearing off of the central strip at least partly above the second face of the sealing film, in which the wiping element is attached to a component selected from the group consisting of the sealing film, a foam layer attached to the sealing film, a non foam support attached to the sealing film, and combinations thereof, by at least one connecting means ensuring a pressure between the lateral portions of the wiping element and the component, whereby a passage is defined between said lateral portions of the wiping element, and between the central portion of the wiping element and the component.

85. The toner container of claim 84, in which the connecting means exert a pressure between the lateral portions of the wiping element and the component sufficient for forming guiding means for torn central strip during its tearing.

86. The toner container of claim 84, in which the connecting means exert a pressure between the lateral portions and the component which is greater than the pressure of the central portion of the wiping element and the component.

87. The toner container of claim 84, in which the connecting means is adapted for preventing the tearing off of the wiping element during the tearing of the central strip.

88. The toner container of claim 84, in which the connecting means is a mechanical means acting at least between the lateral portions of the wiping element and the component.

89. The toner container of claim 84, which is associated with a support bearing at least one roller, whereby the sealing member is located between the surface with the opening of the container and the support and whereby the support is provided with a surface adapted with respect to the surface with the opening, so as to ensure a pressure between the lateral portions of the wiping element and the component.

90. The toner container of claim 84, in which the connecting means is an element attached to the container.

91. The toner container of claim 84, in which the connecting means is an element attached to the support.

92. The toner container of claim 84, in which the sealing film is provided with gluing means for attaching the sealing film on the surface of the container with the opening to be sealed.

93. The toner container of claim 84, in which the sealing film is provided with at least one foam element.

94. The toner container of claim 84, in which the sealing film is provided with at least one foam element, said foam element being provided with gluing means for attaching the sealing member to the surface of the container with the opening to be sealed.

95. The toner container of claim 84, which is associated to a means for ensuring at least a transversal stretching of the wiping element, when the sealing film seals the opening of the toner container.

96. The toner container of claim 84, in which the wiping element extends at least partly outside the sealing film.

97. The toner container of claim 84, in which the wiping element is covered at least partly by a film element.

98. A toner container for laser printers, copy machines and fax machines, said toner having a surface with an opening for the passage of toner, said toner container being provided with a sealing member for sealing the opening, whereby the sealing member comprises:

a sealing film with a first face intended to be directed towards the surface for sealing the opening of the toner container and a second face opposite to said first face, said film comprising a longitudinal central strip intended to be torn off, said central strip extending from a first end up to a second end and having a substantially predetermined width, a wiping element for wiping the portion of the first face of the sealing film corresponding to the central strip when contacting the torn central strip with the wiping element, the wiping element having two lateral side portions and a central portion extending between said lateral portions, a pulling member bound to the first end of the central strip, said pulling member being intended to extend before the tearing off of the central strip at least partly above the second face of the sealing film, in which the wiping element is attached to a component selected from the group consisting of the sealing film, a foam layer attached to the sealing film, a non foam support attached to the sealing film, and combinations thereof, by at least one connecting means adapted for ensuring a pressure between the lateral portions of the wiping element and the surface with the sealed opening, while defining a passage for the pulling means and the central strip after its tearing, between said lateral portions of the wiping element, and between the central portion of the wiping element and the component.

99. The toner container of claim 98, in which the connecting means exerts a pressure between the lateral portions of the wiping element and the component sufficient for forming guiding means for torn central strip during its tearing.

100. The toner container of claim 98, in which the connecting means exerts a pressure between the lateral portions and the component which is greater than the pressure of the central portion of the wiping element and the component.

101. The toner container of claim 98, in which the connecting means is adapted for preventing the tearing off of the wiping element during the tearing of the central strip.

102. The toner container of claim 98, in which the connecting means is a mechanical means acting at least between the lateral portions of the wiping element and the component.

103. The toner container of claim 98, which is associated with a support bearing at least one roller, whereby the sealing member is located between the surface with the opening of the container and the support and whereby the support is provided with a surface adapted with respect to the surface with the opening, so as to ensure a pressure between the lateral portions of the wiping element and the component.

104. The toner container of claim 98, in which the connecting means is an element attached to the container.

105. The toner container of claim 98, in which the connecting means is an element attached to the support.

106. The toner container of claim 98, in which the sealing film is provided with gluing means for attaching the sealing film on the surface of the container with the opening to be sealed.

107. The toner container of claim 98, in which the sealing film is provided with at least one foam element.

108. The toner container of claim 98, in which the sealing film is provided with at least one foam element, said foam element being provided with gluing means for attaching the sealing member to the surface of the container with the opening to be sealed.

109. The toner container of claim 98, which is associated to a means for ensuring at least a transversal stretching of the wiping element, when the sealing film seals the opening of the toner container.

110. The toner container of claim 98, in which the wiping element extends at least partly outside the sealing film.

111. The toner container of claim 98, in which the wiping element is covered at least partly by a connecting element.

112. A toner container for laser printers, copy machines and fax machines, said toner having a surface with an opening for the passage of toner, said toner container being provided with a sealing member for sealing the opening, whereby the sealing member comprises:

a sealing film with a first face intended to be directed towards the surface for sealing the opening of the toner container and a second face opposite to said first face, said film comprising a longitudinal central strip intended to be torn off, said central strip extending from a first end up to a second end and having a substantially predetermined width, a wiping element for wiping the portion of the first face of the sealing film corresponding to the central strip when contacting the torn central strip with the wiping element, the wiping element having two lateral side portions and a central portion extending between said lateral portions, a pulling member bound to the first end of the central strip, said pulling member being intended to extend before the tearing off of the central strip at least partly above the second face of the sealing film, in which the wiping element is attached to a component selected from the group consisting of the sealing film, a foam layer attached to the sealing film, a non foam support attached to the sealing film, and combinations thereof, and in which at least one connecting means ensure a pressure between the lateral portions of the wiping element and the component, whereby a passage is defined between said lateral portions of the wiping element, and between the central portion of the wiping element and the component.

113. The toner container of claim 112, in which the connecting means exert a pressure between the lateral portions of the wiping element and the component sufficient for forming guiding means for torn central strip during its tearing.

114. The toner container of claim 112, in which the connecting means exert a pressure between the lateral portions and the component which is greater than the pressure of the central portion of the wiping element and the component.

115. The toner container of claim 112, in which the connecting means is adapted for preventing the tearing off of the wiping element during the tearing of the central strip.

116. The toner container of claim 112, in which the connecting means is a mechanical means acting at least on the lateral portions of the wiping element.

117. The toner container of claim 112, which is associated with a support bearing at least one roller, whereby the sealing member is located between the surface with the opening of the container and the support and whereby the support is provided with a surface adapted with respect to the surface with the opening, so as to ensure a pressure between the lateral portions of the wiping element and the component.

118. The toner container of claim 112, in which the connecting means is an element attached to the container.

119. The toner container of claim 112, in which the connecting means is an element attached to the support.

120. The toner container of claim 112, in which the sealing film is provided with gluing means for attaching the sealing film on the surface of the container with the opening to be sealed.

121. The toner container of claim 112, in which the sealing film is provided with at least one foam element.

122. The toner container of claim 112, in which the sealing film is provided with at least one foam element, said foam element being provided with gluing means for attaching the sealing member to the surface of the container with the opening to be sealed.

123. The toner container of claim 112, which is associated to a means for ensuring at least a transversal stretching of the wiping element, when the sealing film seals the opening of the toner container.

124. The toner container of claim 112, in which the wiping element extends at least partly outside the sealing film.

125. The toner container of claim 112, in which the wiping element is covered at least partly by a film element.

* * * * *